US006568954B2

(12) United States Patent
Endo et al.

(10) Patent No.: US 6,568,954 B2
(45) Date of Patent: May 27, 2003

(54) HALF-FITTING PREVENTION CONNECTOR AND ASSEMBLING METHOD THEREOF

(75) Inventors: Tomomi Endo, Haibara-gun (JP); Naoto Taguchi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/118,218

(22) Filed: Apr. 9, 2002

(65) Prior Publication Data

US 2002/0160651 A1 Oct. 31, 2002

(30) Foreign Application Priority Data

Apr. 12, 2001 (JP) ..... 2001-114405
Sep. 5, 2001 (JP) ..... 2001-269062

(51) Int. Cl.[7] ..... H01R 3/00
(52) U.S. Cl. ..... 439/489; 439/352
(58) Field of Search ..... 439/489, 488, 439/491, 352, 353, 357, 358

(56) References Cited

U.S. PATENT DOCUMENTS 5,507,666 A 4/1996 Yamanashi
5,827,086 A 10/1998 Fukuda
5,848,912 A 12/1998 Okabe
5,938,470 A 8/1999 Kashiyama
6,012,946 A * 1/2000 Fukase ..... 439/489
6,027,364 A 2/2000 Fukuda
6,171,130 B1 1/2001 Yoshida et al.
6,315,585 B1 * 11/2001 Oka ..... 439/489
6,475,015 B1 * 11/2002 Murakami et al. ..... 439/352

FOREIGN PATENT DOCUMENTS

| | | |
|---|---|---|
| EP | 0 774 804 A2 | 5/1997 |
| EP | 0 821 441 A2 | 1/1998 |
| EP | 0 981 185 A2 | 2/2000 |
| EP | 1 113 537 A2 | 7/2001 |
| EP | 1 180 825 A2 | 2/2002 |
| JP | 8-31517 | 2/1996 |
| JP | 9-134757 | 5/1997 |
| JP | 9-148003 | 6/1997 |
| JP | 9-180818 | 7/1997 |

* cited by examiner

*Primary Examiner*—Tho D. Ta
(74) *Attorney, Agent, or Firm*—Sughrue Mion, PLLC

(57) ABSTRACT

In a half-fitting prevention connector (31) of the invention, when a pair of connector housings (40, 50) are fitted together, a half-fitted condition of the connector housings (40, 50) is detected by determining whether or not a fitting detection member (60) on first connector housing (40) can be slid into a proper fitting detection position. The proper fitting detection position of the fitting detection member (60) is set at a position which is nearer relative to a front end of the housing than its initial position is. Therefore, by one operation for fitting the two connector housings together, with the fitting detection member held with the hand, the housing-fitting operation and the detection member-moving operation can be completed at a time. And besides, there is no need to change the positions of the fingers during this operation, and the housing-fitting operation can be effected with a reduced number of operations.

13 Claims, 18 Drawing Sheets

HALF-FITTING PREVENTION CONNECTOR AND ASSEMBLING METHOD THEREOF

BACKGROUND OF THE INVENTION

1. Field of the Invention

This invention relates to a half-fitting prevention connector-assembling method and a half-fitting prevention connector, in which when a pair of male and female connector housings are fitted together, a half-fitted condition of the male and female connector housings is detected by determining whether or not a fitting detection member, mounted on one of the first and second connector housings, can be slid into a proper fitting detection position.

The present application is based on Japanese Patent Applications No. 2001-114405 and No. 2001-269062, which are incorporated herein by reference.

2. Related Art

In a conventional half-fitting prevention connector shown in FIGS. 18 and 19, when a pair of male and female connector housings 1 and 9 are fitted together, a half-fitted condition of the male and female connector housings 1 and 9 is detected by determining whether or not a fitting detection member 2, mounted on the male connector housing (first connector housing) 9, can be slid into a proper fitting detection position (see JP-A-8-31517).

As shown in FIG. 19, the male connector housing 1 has a flexible lock arm 4 rising from an upper wall 3 at a front end thereof and further extending toward a rear end of the housing, and a lock portion 6 is formed on an intermediate portion of an upper surface of this flexible lock arm 4 in a projected manner.

A pressing plate portion 7 is provided at a free end of the flexible lock arm 4 disposed near to the rear end of the male connector housing 1, and this pressing plate portion 7 serves as an operating portion for elastically displacing the flexible lock arm 4 when fitting the male and female connector housings together.

The female connector housing 9 has an engagement portion 10 formed on an inner surface of an upper wall thereof at a front end thereof which upper wall overlies the flexible lock arm 4 when fitting the male and female connector housings 1 and 9 together.

As shown in FIGS. 20 and 21, when the fitting length of the male and female connector housings 1 and 9 relative to each other reaches a proper value, the engagement portion 10 slides over the lock portion 6 through the elastic displacement of the flexible lock arm 4. When the fitting length of the male and female connector housings 1 and 9 reaches the proper value, the engagement portion 10 becomes engaged in a recess 6*a*, disposed at the rear side of the lock portion 6, from the upper side, to retain the lock portion 6, thereby locking the male and female connector housings 1 and 9 in a fitted condition.

As shown in FIGS. 18 and 19, the fitting detection member 2 includes an operating plate portion 16, which is slidably engaged with the pressing plate portion 7 so as to slide in a fitting direction of the male and female connector housings, a resilient piece portion 17, extending from a rear end of the operating plate portion 16 toward the front ends of the male and female connector housings, and a positioning retaining portion 20 formed at a distal end of the resilient piece portion 17 in a projected manner, these portions being formed integrally with one another. The resilient piece portion 17 has a bar-like shape, and can pass through a space between a pair of side plate portions 5 of the flexible lock arm 4.

As shown in FIG. 18, the positioning retaining portion 20 is in the form of a projection, and can be fitted into each of recesses 6*a* and 6*b*, disposed respectively at the rear and front sides of the lock portion 6, from the lower side by the resilient force of the resilient piece portion 17. Before the male and female connector housings are fitted together, this positioning retaining portion 20 is kept fitted in the recess 6*a* at the rear side of the lock portion 6, and is retained by a rear edge of the lock portion 6, and therefore is prevented form forward movement.

The position where the positioning retaining portion 20 is abutted against the rear edge of the lock portion 6, and is prevented from forward movement is an initial position of the fitting detection member 2 mounted on the male connector housing 1.

With respect to the sliding engagement between the pressing plate portion 7 and the operating plate portion 16, the sliding range is so determined that the fitting detection member 2 can slide between the proper fitting detection position, set forwardly of the above initial position, and this initial position.

When the pair of male and female connector housings 1 and 9 are fitted together, the fitting length of the male and female connector housings 1 and 9 reaches the proper value, so that the engagement portion 10 is fitted in the recess 6*a* at the rear side of the lock portion 6, as shown in FIG. 21.

Therefore, the positioning retaining portion 20 of the fitting detection member 2, already fitted in the recess 6*a*, is downwardly pushed out of this recess by the engagement portion 10, so that the holding of the positioning retaining portion 20 in the initial position is canceled. As a result, the fitting detection member 2 can be slid by pushing the operating plate portion 16 forward as indicated by arrow A in the drawings.

When the fitting detection member 2 is pushed forward after the holding of the positioning retaining portion 20 in the initial position is canceled, this positioning retaining portion 20 moves forward in sliding contact with the lower surfaces of the engagement portion 10 and lock portion 6, as shown in FIG. 22. Then, when the positioning retaining portion 20 moves past the front edge of the lock portion 6, this portion 20 is displaced upwardly by the resilient force of the resilient piece portion 17, and is fitted into the recess 6*b* at the front side of the lock portion 6.

Therefore, the positioning retaining portion 20, thus fitted in the recess 6*b*, is retained at its rear end surface by the front end surface of the lock portion 6, and is held in a locked condition, that is, prevented from rearward sliding movement.

However, if the fitting length of the male and female connector housings 1 and 9 does not reach the proper value, thus inviting a half-fitted condition, when the male and female connector housings 1 and 9 are fitted together, the engagement portion 10 of the female connector housing 9 will not be fitted into the recess 6*a* at the rear side of the lock portion 6.

Therefore, the positioning retaining portion 20 will not be pushed out of the recess 6*a* by the engagement portion 10, and therefore the holding of the fitting detection member 2 in the initial position by the lock portion 6 will not be canceled.

Therefore, in the half-fitted condition of the male and female connector housings 1 and 9, even when the operating plate portion 16 is pushed forward, the fitting detection member 2 will not be moved forward, and therefore the half-fitted condition can be detected by determining whether or not the fitting detection member 2 can be moved forward.

In the operation for fitting the pair of male and female connector housings 1 and 9 together, the connector housings 1 and 9 are directly held with the fingers of the hands, and then the two connector housings 1 and 9 are fitted together.

In the operation for moving the detection member in order to judge the fitted condition of the two connector housings 1 and 9, the fingers of the hand, holding the male connector housing 1, are shifted into positions where the operating plate portion 16 of the fitting detection member 2 can be pushed by these fingers, and then the fitting detection member 2 is moved from the initial position to the proper fitting detection position.

Further, a housing-pulling confirmation operation is effected in order to confirm whether or not the locked condition of the male and female connector housings is incomplete because of damage to the lock portion 6 or others even if the fitting detection member 2 can be properly moved into the proper fitting detection position. In this operation, the two housings are held with the fingers of the right and left hands, and are pulled away from each other in order to confirm the locked condition of the male and female connector housings.

Thus, the above three independent operations must be sequentially carried out, which has invited a problem that the number of the operations is large.

And besides, each time the operation is shifted to the next operation, the fingers, holding the side surfaces of the male connector housing 1, need to be shifted onto the operating plate portion 16 of the fitting detection member 2, or the fingers, holding the fitting detection member 2, need to be shifted to the side surfaces of the male connector housing 1, and therefore there has been encountered a problem that the efficiency of the operation is lowered since the positions of the fingers are changed.

Furthermore, the fitting detection member 2 is a relatively-small component part fitted on the flexible lock arm 4 on the male connector housing 1, and the male connector housing 1 and the fitting detection member 2 are formed of resin materials having substantially the same color, and therefore when the fitting detection member is mounted on the male connector housing 1, it is rather inconspicuous. Therefore, there has been encountered a problem that for example, at the time of the maintenance and inspection, it is not easy to confirm whether the fitting detection member is disposed in the initial position or in the proper fitting detection position.

SUMMARY OF THE INVENTION

This invention has been made in view of the above problems, and an object of the invention is to provide a half-fitting prevention connector, as well as a half-fitting prevention connector-assembling method, in which when fitting two connector housings together, a housing-fitting operation and a detection member-moving operation can be completed at the same time with one operation, so that the number of the operations, required for connecting the two connector housings together, can be reduced.

Another object is to provide a half-fitting prevention connector, as well as a half-fitting prevention connector-assembling method, in which when the operation is to be shifted to the next operation, there is no need to change the positions of the fingers, holding the housing, and the next operation can be carried out efficiently, and the efficiency of the operation for connecting the two connector housings together can be enhanced.

A further object is to provide a half-fitting prevention connector in which for example, at the time of the maintenance and inspection, it can be easily confirmed with the eyes whether a fitting detection member is disposed in an initial position or in a proper fitting detection position.

(1) According to the invention, there is provided a method of assembling a half-fitting prevention connector, the connector including a first connector housing having a flexible lock arm formed on an upper surface of a housing body; a second connector housing having an engagement portion engagable with a lock portion of the flexible lock arm and connected to the first connector housing by the engagement of the lock portion with the engagement portion when the second connector housing is fitted relative to the first connector housing; and a fitting detection member having a positioning retaining portion for engagement with the lock portion and slidably mounted on the first connector housing in a fitting direction of the first and second connector housings, wherein a half-fitted condition of the first and second connector housings is detected by determining whether or not the fitting detection member can be slidingly moved;

the method of assembling comprising the steps of:

holding the fitting detecting member at an initial position by engagement of the lock portion with the positioning retaining portion and fitting of the fitting detection member on an outer periphery of the first connector housing before the first and second connector housings are fitted together;

pushing the fitting detection member mounted on the first connector housing toward a front side of the first connector housing in the fitting direction in an operation for fitting the first and second connector housings together;

completely fitting the first and second connector housings by engaging the engagement portion of the second connector housing with the lock portion of the flexible lock arm;

pushing the positioning retaining portion out of the lock portion, thereby canceling holding of the fitting detection member in the initial position relative to the first connector housing;

sliding the fitting detection member from the initial position to a proper fitting detection position which is nearer to a front end of the first connector housing than the initial position; and holding the fitting detection member in the proper fitting detection position by a retaining device for holding the fitting detection member in the proper fitting detection position, thereby detecting a completely-fitted condition of the first and second connector housings.

In this half-fitting prevention connector-assembling method, by pushing the fitting detection member, mounted on the first connector housing, forward in the fitting direction, the two connector housings are completely fitted together, and also the fitting detection member is slid into the proper fitting detection position, and is held in this position. Therefore, the operation for fitting the two connector housings together and the detection member-moving operation can be completed by one pushing operation.

(2) The above objects have been achieved by a half-fitting prevention connector comprising:

a first connector housing having a flexible lock arm formed on an upper surface of a housing body thereof;

a second connector housing having an engagement portion engagable with a lock portion of the flexible lock arm to thereby be connected to the first connector housing when the second connector housing is fitted relative to the first connector housing; and a fitting detection member mounted on the first connector housing so as to slide in a fitting direction of the first and second connector housings for detecting a half-fitted condition of the first and second connector housings by determining whether or not the fitting detection member can be slidingly moved, the fitting detection member including a detection member body of a substantially tubular shape fitted on an outer periphery of the first connector housing so as to slide in the fitting direction of the first and second connector housings and a positioning retaining portion for engagement with the lock portion to hold the detection member body in an initial position;

wherein the detection member body is held in the initial position by the engagement of the lock portion with the positioning retaining portion before the first and second connector housings are fitted together;

the positioning retaining portion is pushed out of the lock portion upon engagement of the engagement portion with the lock portion, so that the engagement of the positioning retaining portion with the lock portion is canceled, when the first and second connector housings are completely fitted together;

the detection member body is slid from the initial position to a proper fitting detection position near to a front end of the first connector housing; and the fitting detection member is held in the proper fitting detection position by a retaining device for retaining the first connector housing and the fitting detection member to each other.

In the half-fitting prevention connector of the above construction, the fitting detection member, mounted on the first connector housing, before fitted relative to the second connector housing, is held and retained in the initial position by the lock portion, and substantially covers the outer periphery of the first connector housing. Therefore, when effecting the operation for fitting the pair of female and male connector housings together, this fitting operation can be carried out, with the fitting detection member kept held with the fingers.

After the housing-fitting operation is finished, the detection member-moving operation for moving the fitting detection member from the initial position to the proper fitting detection position is effected in order to detect the fitted condition of the female and male connector housings. At this time, if the fitting detection member is held with the fingers at the time of the housing-fitting operation, the fitting detection member can be moved in the next detection member-moving operation merely by pushing the fitting detection member toward the front side of the housing, without the need for changing the positions of the fingers.

Namely, the detection member-moving operation is an operation for moving the fitting detection member toward the front side of the housing, and the pushing direction in this operation is the same as that in the housing-fitting operation, and therefore by one pushing operation for effecting the housing-fitting operation, the operation, including the detection member-moving operation, can be completed at a time.

When the fitting detection member reaches the proper fitting detection position, the sliding movement of the fitting detection member is limited by the retaining device which retains the first connector housing and the fitting detection member relative to each other.

Therefore, in a housing-pulling confirmation operation for pulling the female and male connector housings away from each other, the fitting detection member need only to be pulled toward the rear side of the housing, and when the operation is shifted from the detection member-moving operation to the housing-pulling confirmation operation, this can be carried out smoothly without the need for changing the positions of the fingers holding the detection fitting member.

(3) In the half-fitting prevention connector according to (2), preferably, the fitting detection member has an extension portion which projects beyond a rear end of the first connector housing when the fitting detection member is disposed in the initial position, and is disposed on the outer periphery of the first connector housing when the fitting detection member is disposed in the proper fitting detection position, and the position of the extension portion in the initial position of the fitting detection member is clearly different from the position of the extension portion in the proper fitting detection position of the fitting detection member.

In the half-fitting prevention connector of this construction, at the time of the assembling operation, the maintenance and inspection or others, whether the fitting detection member is disposed in the initial position or in the proper fitting detection position can be easily judged by confirming the position of the extension portion with the eyes.

(4) In the half-fitting prevention connector of (2) or (3), preferably, the retaining device includes first retaining mechanism for retaining the fitting detection member at a front portion of the first connector housing, and second retaining mechanism for retaining the fitting detection member at a rear portion of the first connector housing.

In the half-fitting prevention connector of this construction, the retaining of the fitting detection member in the proper fitting detection position can be effected at the front and rear portions of the fitting detection member. Therefore, the fitting detection member can be firmly retained in the proper fitting detection position.

(5) In the half-fitting prevention connector of (4), preferably, the first retaining mechanism comprises the positioning retaining portion, and a detection member-retaining portion defined by a front end edge of the flexible lock arm.

In the half-fitting prevention connector of this construction, there is no need to provide a retaining hole or the like exclusively used as the first retaining mechanism, and the first retaining mechanism can be provided by the positioning retaining portion and the detection member-retaining portion defined by the front end edge of the flexible lock arm, and the fitting detection member and the first connector housing can be simplified in construction and shape.

(6) In the half-fitting prevention connector of (4), preferably, the second retaining mechanism comprises a first projection, formed on a rear portion of a bottom portion of the first connector housing, and a second projection formed on a bottom portion of an inner peripheral surface of the fitting detection member, or the second retaining mechanism comprises an elastic retaining portion, formed on the rear portion of the bottom portion of the first connector housing, and a retaining rib extending between inner surfaces of opposite side walls of the fitting detection member at a lower portion thereof.

In the half-fitting prevention connector of this construction, the retaining of the fitting detection member in the proper fitting detection position can be effected at the upper portion of the front portion of the fitting detection member and the rear portion of the bottom portion thereof, and a relative slight movement or shaking between the fitting detection member and the first connector housing is suppressed, so that the fitting detection member can be more firmly retained.

(7) In the half-fitting prevention connector of (4), and the second retaining mechanism comprises retaining projections, formed respectively on opposite side surfaces of the flexible lock arm at a rear end thereof, and retaining piece portions formed respectively on opposed inner side surfaces of the fitting detection member at an upper end portion thereof, or the second retaining mechanism comprises a detection member-retaining arm, which is disposed adjacent to one side of the flexible lock arm, and has an engaging claw formed on an upper surface at a rear end thereof, and a retaining wall formed on a rear end of an upper wall of the fitting detection member.

In the half-fitting prevention connection of this construction, the first and second retaining mechanisms are disposed at the upper surface, and therefore the retained condition can be confirmed with the eyes, and the fitted condition of the two connector housings can be confirmed with the eyes. And besides, since the first and second retaining mechanisms are disposed at the upper surface, the operation for canceling the retained condition of the retaining mechanisms can be effected while confirming it with the eyes, and therefore the cancellation operability can be enhanced.

(8) In the half-fitting prevention connector of (2), preferably, the fitting detection member is designed such that an inserting force, required when retaining the fitting detection member in the proper fitting detection position by the retaining device, is smaller than an inserting force required for fitting the two connector housings together.

(9) In the half-fitting prevention connector of (8), preferably, a height of engagement between the first and second projections is smaller than a height of engagement between the lock portion and the engagement portion, or an angle of inclination of a tapering surface of the retaining piece portion is smaller than an angle of inclination of the engagement portion.

In the half-fitting prevention connector of this construction, the inserting force, required for the detection member-moving operation, is smaller than the inserting force required for the connector-fitting operation, and therefore the detection member-moving operation can be effected by a pushing force of inertia produced when fitting the two connector housings together. Therefore, the operation for fitting the two connector housings together and the operation for moving the detection member can be effected successively with one pushing operation.

(10) In the half-fitting prevention connector of (2), preferably, different colors are applied respectively to an outer surface of the fitting detection member and at least that portion of an outer surface of the first connector housing, exposed from the fitting detection member, so that the appearance of the first connector housing, obtained when the fitting detection member is disposed in the initial position, is clearly different in color from the appearance obtained when the fitting detection member is disposed in the proper fitting detection position.

In the half-fitting prevention connector of this construction, at the time of the assembling operation, the maintenance and inspection or others, whether or not the fitting detection member is disposed in the initial position or in the proper fitting detection position can be easily confirmed by viewing the color pattern formed by the first connector housing and the fitting detection member.

DETAILED DESCRIPTION OF THE PREFERRED EMBODIMENTS

Figure 1:
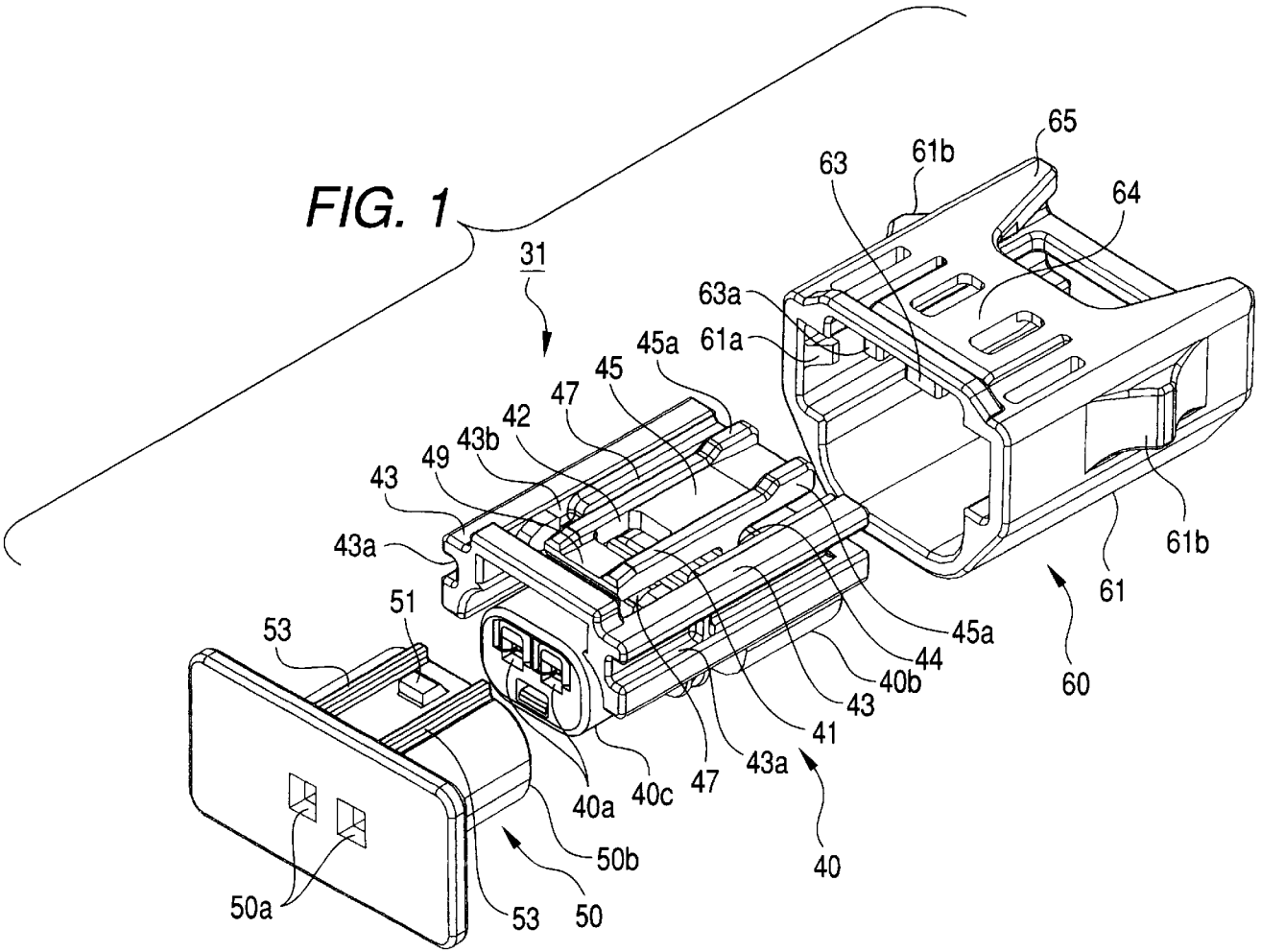
FIG. 1 is an exploded, perspective view of a first embodiment of a half-fitting prevention connector of the invention.
Figure 2:
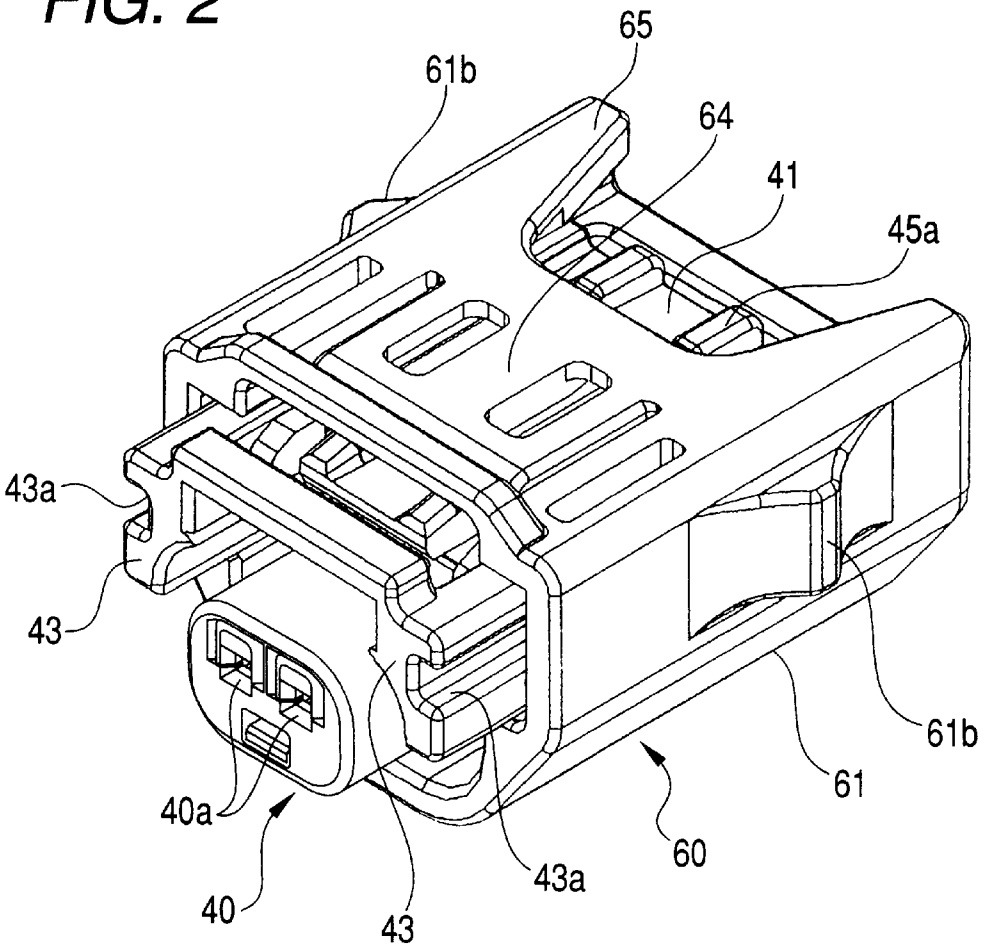
FIG. 2 is a perspective view showing a condition in which a fitting detection member is mounted on a female connector housing of FIG. 1.
Figure 3:
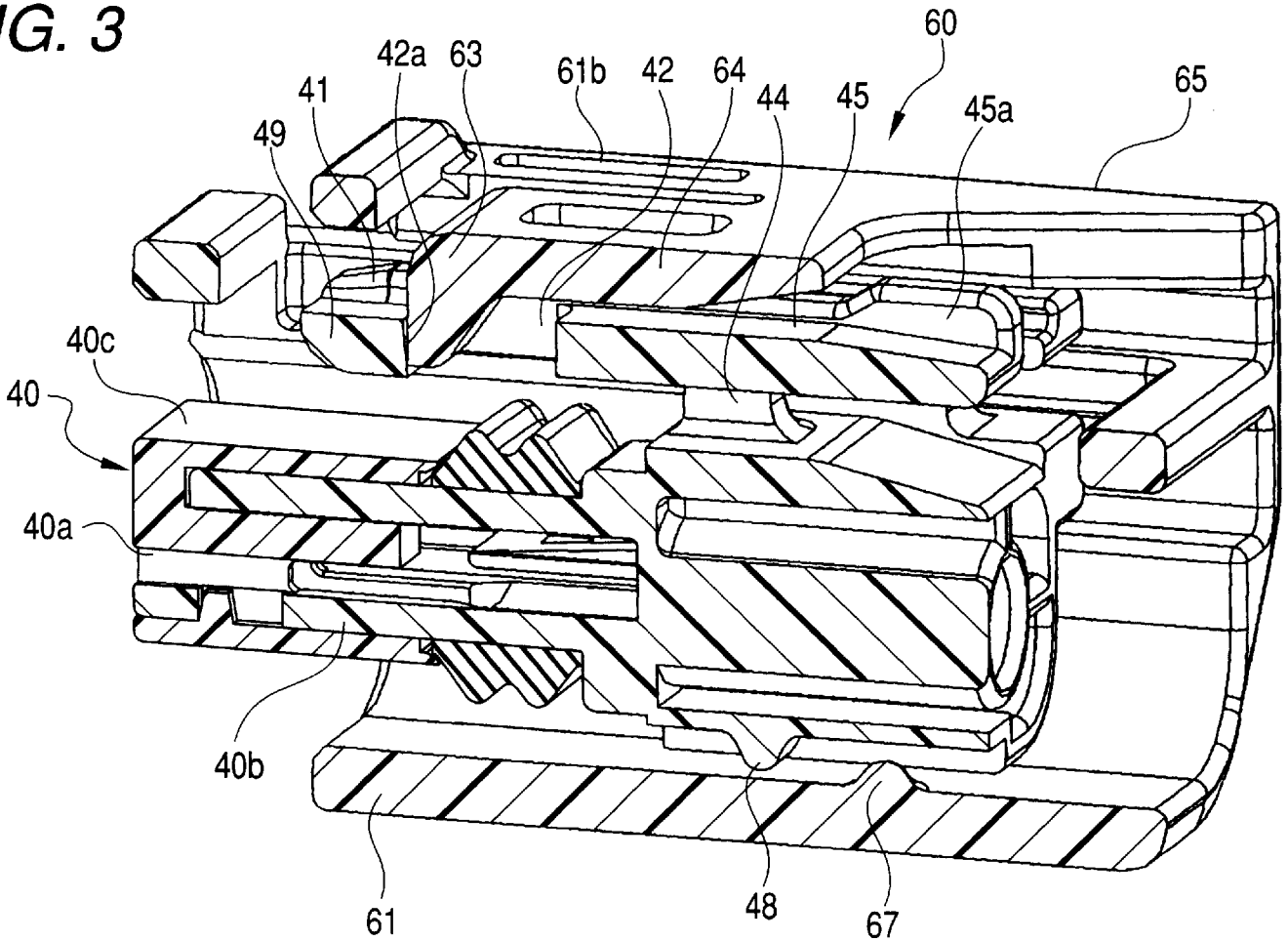
FIG. 3 is a vertical cross-sectional view in FIG. 2.
Figure 4:
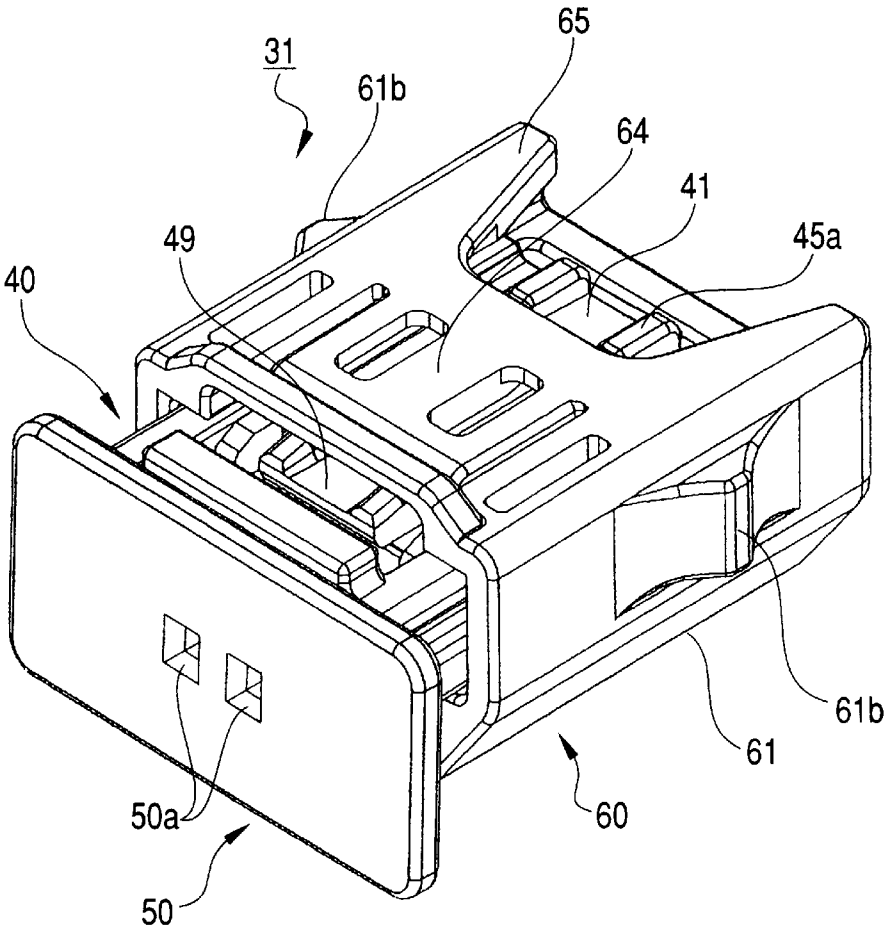
FIG. 4 is a perspective view showing a condition in which the female and male connector housings of FIG. 1 are in the process of being fitted together.
Figure 5:
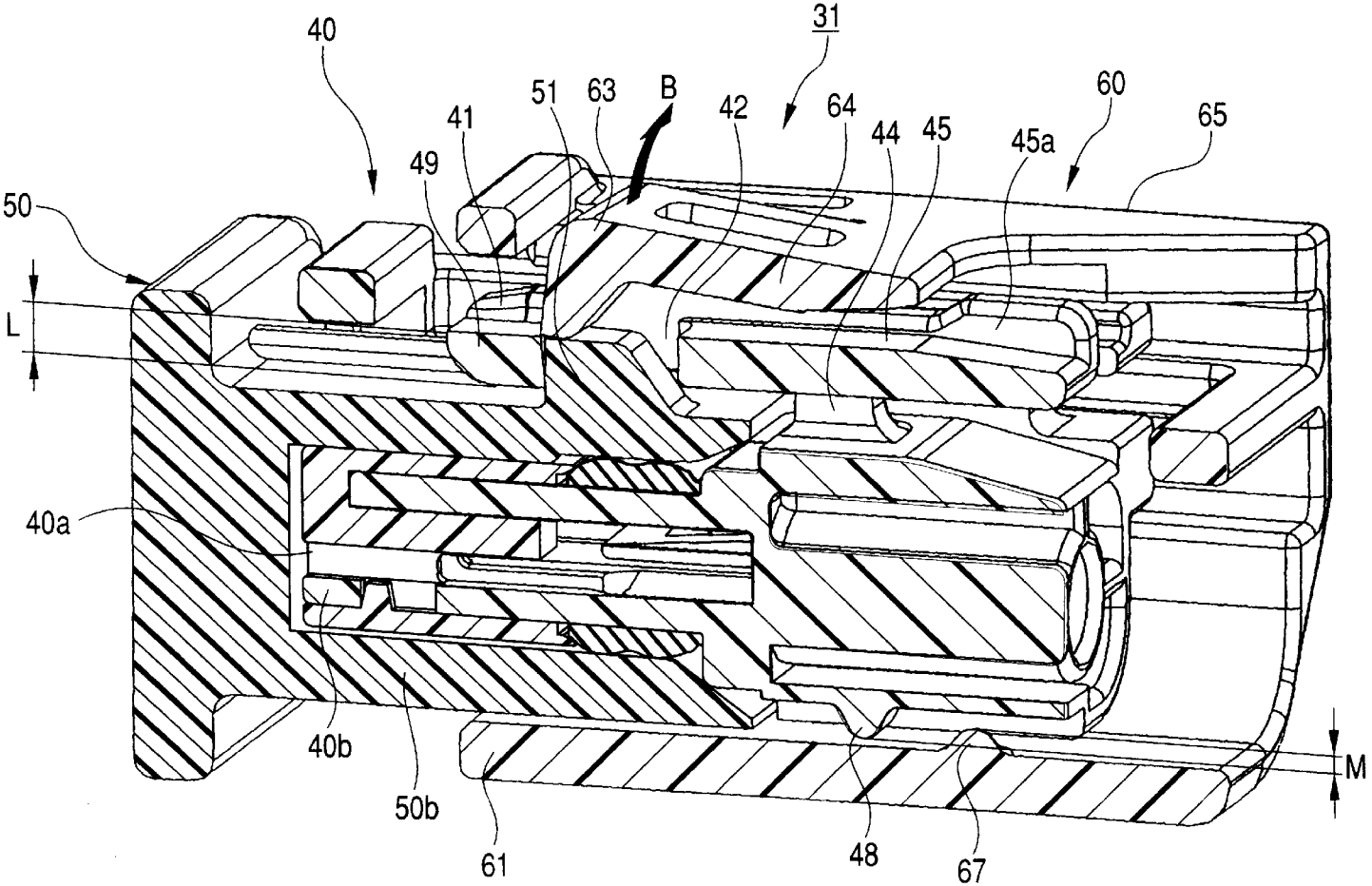
FIG. 5 is a vertical cross-sectional view in FIG. 4.
Figure 6:
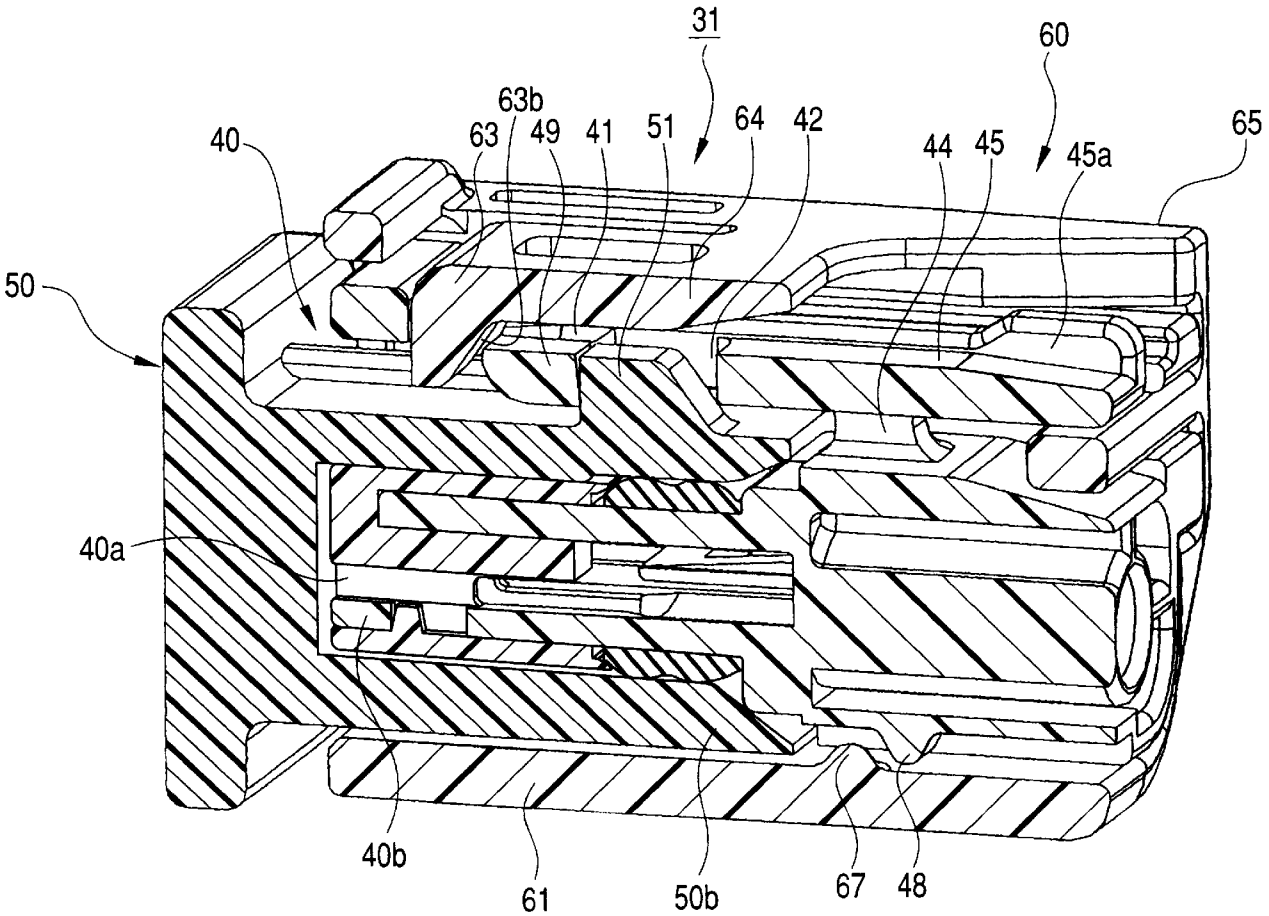
FIG. 6 is a vertical cross-sectional view showing the female and male connector housings of FIG. 5 in a completely-fitted condition.

A first embodiment of a half-fitting prevention connector of the present invention will now be described in detail with reference to FIGS. 1 to 6. FIG. 1 is an exploded, perspective view of the first embodiment of the half-fitting prevention connector of the invention, FIG. 2 is a perspective view showing a condition in which a fitting detection member is mounted on a female connector housing of FIG. 1, FIG. 3 is a vertical cross-sectional view in FIG. 2, FIG. 4 is a perspective view showing a condition in which the female and male connector housings of FIG. 1 are in the process of being fitted together, FIG. 5 is a vertical cross-sectional view in FIG. 4, and FIG. 6 is a vertical cross-sectional view showing the female and male connector housings of FIG. 5 in a completely-fitted condition.

As shown in FIG. 1, the half-fitting prevention connector 31 of this embodiment comprises a female connector (first connector housing) 40, having a flexible lock arm 41, a male connector (second connector housing) 50 having an engagement projection (engagement portion) 51 for engagement in a retaining hole 42 (serving as a lock portion) formed in the flexible lock arm 41, and the fitting detection member 60 of a substantially tubular shape mounted on the female connector 40 so as to slide in a fitting direction.

Namely, before the female and male connectors 40 and 50 are fitted together, the fitting detection member 60 is engaged in the retaining hole 42, and therefore is held in its initial position. When the female and male connectors 40 and 50 are completely fitted together, the position holding by the retaining hole 42 is canceled by engagement of the engagement projection 51 in the retaining hole 42, and the fitting detection member 60 is slid from the initial position to a proper fitting detection position spaced a predetermined distance from the initial position. Therefore, a half-fitted condition of the female and male connectors 40 and 50 can be detected by determining whether or not the fitting detection member 60 can be slid into the proper fitting detection position.

The female connector 40 of this embodiment includes a housing body 40*b*, having terminal receiving chambers 40*a* for respectively receiving and holding female connection terminals (not shown), the flexible lock arm 41, formed on an upper surface of the housing body 40*b*, and guide portions 43 for slidably supporting the fitting detection member 60, these portions being molded integrally with one another. A front holder 40*c* is mounted on a front end portion of the housing body 40*b*, and forms the terminal receiving chambers 40*a* continuous with the housing body 40*b*.

The flexible lock arm 41 includes an arm portion 45 formed on upper ends of support post portions 44 formed on a substantially central portion of the upper surface of the housing body 40*b*, and the arm portion 45 extends in a forward-rearward direction relative to the housing body 40*b*, and can be elastically displaced upward and downward on the support post portions 44 serving as a fulcrum.

In the flexible lock arm 41, the retaining hole 42 is formed through that portion of the arm portion 45 disposed near to the front end thereof. Cancellation operating portions 45*a* for upwardly displacing the front of the arm portion 45 are formed on that portion of the upper surface of the arm portion 45 disposed adjacent to the rear end thereof.

Therefore, in the fitted condition of the female and male connectors 40 and 50 in which the engagement projection 51 of the male connector 50 is engaged in the retaining hole 42, when the cancellation operating portions 45*a* are depressed to displace the front end of the arm portion 45 upwardly, the engagement of the engagement projection 51 in the retaining hole 42 is canceled.

The guide portions 43 are formed respectively at opposite sides of the upper surface of the housing body 40*b* in such a manner that the flexible lock arm 41 is disposed between these guide portions 43. Each of the guide portions 43 has a guide groove 43*a* formed in an outer surface thereof and extending in the forward-rearward direction of the housing body 40*b*.

As shown in FIG. 3, the female connector 40 of this embodiment has a first projection 48 (serving as second retaining mechanism) of a rib-like shape formed on that portion of the outer peripheral surface thereof facing away from the flexible lock arm 41, the first projection 48 extending transversely, that is, in a direction perpendicular to the fitting direction. Preferably, the first projection 48 has a triangular cross-sectional shape, having gently-slanting surfaces, or a semi-circular cross-sectional shape. The first projection 48 can engage a second projection 67 (described later) to prevent the fitting detection member 60 from moving rearward after the completely-fitted condition is achieved.

As shown in FIG. 1, in the male connector 50 of this embodiment, on an upper surface of a housing body 50*b*, there are provided terminal receiving chambers 50*a* for respectively receiving male connection terminals (not shown), the engagement projection 51 for engagement in the retaining hole 42, and elongate projections 53 each for passing through a gap 47 between the flexible lock arm 41 and the corresponding guide portion 43.

The terminal receiving chambers 50*a* receive and hold the male connection terminals (not shown) which are to be connected respectively to the female connection terminals received respectively in the terminal receiving chambers 40*a* in the female connector 40, and these terminal receiving chambers 50*a* are arranged at the same pitch as that of the terminal receiving chambers 40*a*.

The engagement projection 51 is formed on and projects from that portion of the upper surface of the housing body 50*b* disposed near to the front end thereof. When the female and male connectors 40 and 50 are fitted together, the engagement projection 51 moves into sliding contact with the lower surface of the arm portion 45 of the flexible lock arm 41. Then, when the fitting length of the female and male connectors reaches the predetermined value, this engagement projection is fitted into the retaining hole 42 from the lower side of the arm portion 45, and is thus engaged in this retaining hole.

The elongate projections 53 are passed respectively through the gaps 47, provided respectively in the opposite side portions of the female connector 40, thereby controlling the fitting direction of the female and male connectors 40 and 50 and the fitting positions thereof so that the operation for fitting the female and male connectors 40 and 50 together can be carried out smoothly.

The fitting detection member 60 of this embodiment includes a detection member body 61 of a substantially tubular shape, which is fitted on the outer periphery of the female connector 40 so as to slide in the fitting direction of the female and male connectors 40 and 50 together, and covers the outer periphery of the hosing body 40*b*, a retaining projection 63 (serving as a positioning retaining portion (first retaining mechanism)) for engagement in the retaining hole 42 to hold the detection member body 61 in the initial position, and the second projection 67 as the second retaining mechanism (see FIG. 3) formed on the inner peripheral surface thereof so as to be engaged with the first projection 48 in the completely-fitted condition.

Guide projections 61*a* for being slidably fitted respectively in the guide grooves 43*a* of the guide portions 43 are formed respectively on inner side surfaces of the detection member body 61, and this detection member body is mounted on the female connector 40 so as to slide in the fitting direction of the female and male connectors 40 and 50 through the guide projections 61*a* fitted respectively in the guide grooves 43*a*.

Anti-slip portions 61*b*, which are to be held by the fingers when sliding the detection member body 61, are formed on the outer surface of this detection member body 61.

The retaining projection 63 is formed on and projects from a lower surface of a retaining arm (resilient piece portion) 64, which is part of an upper wall of the detection member body 61, at a front end thereof, and when the retaining arm 64 is resiliently displaced upwardly, this retaining projection 63 is displaced upwardly together with the retaining arm 64. This retaining projection 63 is fitted into the retaining hole 42 from the upper side, with its front end surface held against a front end surface 42*a* (see FIG. 3) of the retaining hole 42, thereby holding the fitting detection member 60 in its initial position.

Arm projections 63*a* are formed respectively at opposite sides of the retaining projection 63, and when the fitting detection member 60 is engaged with the female connector 40, these arm projections 63*a* are engaged respectively in retaining recesses 43*b* which are formed in the housing body 40*b*, and are disposed respectively at opposite sides of the retaining hole 42. Therefore, even if the front end of the flexible lock arm 41 is elastically deformed downwardly to thereby cancel the engagement of the retaining projection 63 in the retaining hole 42 before fitting the female connector onto the male connector 50, the fitting detection member 60 will not be disengaged from the female connector 40.

In this embodiment, the proper fitting detection position, to which the fitting detection member 60 is slid, is set at a position which is nearer relative to the front end of the female connector 40 than the initial position (where the retaining projection 63 is retained by the retaining hole 42). Therefore, the female connector 40 is provided with a detection member-retaining portion (first retaining mechanism) 49 for limiting the sliding movement of the fitting detection member 60 when this fitting detection member 60 is slid from the initial position forwardly to the proper fitting detection position.

The detection member-retaining portion 49 is defined by the front end edge of the arm portion 45 of the flexible lock arm 41, and when the fitting detection member 60 is slid to the proper fitting detection position, this detection member-retaining portion 49 retains a rear end surface 63*b* (see FIG. 6) of the retaining projection 63, thereby locating and fixing the fitting detection member 60 in the proper fitting detection position. At this time, a click feeling is produced upon retaining engagement of the retaining projection 63 with the detection member-retaining portion 49, and therefore the completely-fitted condition of the female and male connectors 40 and 50 can be detected.

As shown in FIGS. 3, 5 and 6, the second projection 67 is provided on the inner peripheral surface of the detection member body 61, and when the completely-fitted condition is to be achieved, the fitting detection member 60 is moved toward the front side of the female connector 40, and the second projection 67 slides over the first projection 48, and is engaged therewith. Preferably, those surfaces of the first and second projections 48 and 67, which are brought into contact with each other when the fitting detection member 60 is moved from the initial position to the proper fitting detection position, are gently slanting so that the two contact surfaces can be easily engaged with each other. Also, those surfaces of the first and second projections 48 and 67, which contact each other when the fitting detection member 60 moves rearwardly from the proper fitting detection position, are abruptly slanting in order to prevent the rearward movement of the fitting detection member 60 in the completely-fitted condition.

With this construction, the force of retaining the fitting detection member 60 and the female connector 40 relative to each other is increased, and the fitting detection member 60 can be more firmly held in the proper fitting ;detection position. And besides, when the first projection 48 and the second projection 67 are engaged with each other, a click feeling is produced, and the completely-fitted condition of the female and male connectors 40 and 50 can be detected also by this click feeling.

The height M of engagement between the first and second projections 48 and 67 is smaller than the height of engagement between the retaining hole 42 and the engagement projection 51 (L>M). Therefore, the inserting force, required for sliding the second projection 67 over the first projection 48 and for engaging the former with the latter, is smaller than the inserting force required for fitting the engagement projection 51 into the retaining hole 42. Therefore, the operation for moving the detection member 60 can be completed by a pushing force of inertia produced when fitting the female and male connectors 40 and 50 together, and the operation for fitting the female and male connectors 40 and 50 together and the operation for moving the detection member 60 can be effected successively with one pushing operation.

The fitting detection member 60 of this embodiment has an extension portion 65 so that the rear end of this fitting detection member 60, disposed in its initial position, can clearly project beyond the rear end of the housing of the female connector 40, as shown in FIGS. 2 and 3.

When this fitting detection member is disposed in the proper fitting detection position, the rear end of this extension portion 65 lies substantially flush with the rear end of the housing of the female connector 40, as shown in FIG. 6. Therefore, the position of this extension portion 65 relative to the female connector 40 in the initial position of the fitting detection member 60 is different from the position of the extension portion 65 relative to the female connector 40 in the proper fitting detection position of the fitting detection member 60, and therefore the appearance is clearly changed, so that the fitted condition of the female and male connectors 40 and 50 can be easily detected.

Different colors are applied respectively to the outer surface of the fitting detection member 60 of this embodiment and the outer surface of the housing of the female connector 40, exposed from the fitting detection member 60, so that the appearance, obtained when the fitting detection member 60 is disposed in the initial position relative to the female connector 40, is clearly different in color from the appearance obtained when the fitting detection member 60 is disposed in the proper fitting detection position. Therefore, whether or not the fitting detection member is disposed in the initial position or in the proper fitting detection position can be easily judged by viewing the color pattern formed by the female connector 40 and the fitting detection member 60, and by doing so, the fitted condition of the female and male connectors 40 and 50 can be easily detected.

As described above, in the half-fitting prevention connector 31, before the female and male connectors 40 and 50 are fitted together, the fitting detection member 60, mounted on the female connector 40, is held in the initial position by the retaining function, achieved by the retaining hole 42 in the female connector 40, and covers the female connector 40, as shown in FIGS. 2 and 3.

Therefore, in the housing-fitting operation for fitting the female and male connectors 40 and 50 together, the fitting operation up to the completely-fitted condition can be easily effected, while holding the fitting detection member 60 and the mating male connector 50 with the hands, without the need for holding the female connector 40 with the fingers.

Namely, in the operation for fitting the female and male connectors 40 and 50 together, the fitting length of the two housings reaches the predetermined value, and the engagement projection 51 of the male connector 50 is fitted into the retaining hole 42 from the lower side of the arm portion 45, as shown in FIGS. 4 and 5. By the engagement of the engagement projection 51 in the retaining hole 42, the female and male connectors 40 and 50 are locked in the fitted condition.

At this time, the retaining projection 63 of the fitting detection member 60, already engaged in the retaining hole 42, is pushed upwardly out of this retaining hole by the engagement projection 51 as indicated by arrow B in FIG. 5, thereby canceling the holding of the fitting detection member 60 in the initial position. Therefore, the fitting detection member 60 can be moved toward the front side of the housing of the female connector 40.

After the housing-fitting operation is completed, the detection member-moving operation for moving the fitting detection member 60 from the initial position to the proper fitting detection position is effected in order to detect the fitted condition of the female and male connectors 40 and 50. Namely, in the housing-fitting operation, the fitting detection member 60 is held with the fingers, and therefore when the detection member-moving operation is to be effected, these fingers, holding the fitting detection member, do not need to be shifted, but remain as they are, and are used for pushing the fitting detection member 60 toward the front side of the housing. Therefore, the detection member-moving operation for detecting the completely-fitted condition of the female and male connectors 40 and 50 can be effected efficiently.

The pushing direction in the detection member-moving operation is the same as that in the housing-fitting operation, and therefore by the pushing operation for effecting the housing-fitting operation, the operation, including the detection member-moving operation, can be completed at a time, and the number of the operations, required for connecting the female and male connectors together, can be reduced.

Then, when the fitting detection member 60 reaches the proper fitting detection position as shown in FIG. 6, the retaining projection 63 of the fitting detection member 60 is retained by the detection member-retaining portion 49, defined by the front end edge of the arm portion 45, so that the sliding movement of the fitting detection member 60 is prevented. A click feeling is produced when the retaining projection 63 becomes retained by the detection member-retaining portion 49, and therefore the completely-fitted condition of the female and male connectors 40 and 50 can be detected.

In addition, when the fitting detection member 60 is moved toward the front side of the female connector 40, the second projection 67 slides over the first projection 48, and is engaged therewith, thereby more firmly holding the fitting detection member 60 in the proper fitting detection position.

Next, in the housing-pulling confirmation operation for pulling the female and male connector housings away from each other, the fitting detection member 60 is pulled toward the rear side of the housing, this force is transmitted to the female connector 40 through the fitting detection member 60. Therefore, when the operation is shifted from the detection member-moving operation to the housing-pulling confirmation operation, this can be carried out smoothly without the need for changing the positions of the fingers holding the detection fitting member.

As described above, when connecting the female and male connectors 40 and 50 together, the housing-fitting operation and the detection member-moving operation can be completed at the same time by one operation in which the fitting detection member is grasped, and is pushed forward, and therefore the number of the operations can be reduced. When the operation is to be shifted to the next operation, this shifting can be done without the need for changing the positions of the fingers, holding the male connector 50 and the fitting detection member 60, and the efficiency of the operation for connecting the male and female connectors 40 and 50 together can be enhanced.

And besides, the fitting detection member 60 can be firmly held in the proper fitting detection position by the retaining engagement of the first projection 48 with the second projection 67. The first and second projections 48 and 67 can be brought into retaining engagement with each other by the pushing force of inertia produced when fitting the female and male connectors 40 and 50 together. Therefore, by the pushing operation for effecting the housing-fitting operation, the operation, including the detection member-moving operation, can be completed at a time, and the number of the operations, required for connecting the female and male connectors together, can be reduced.

The detection member-retaining portion 49 is defined by the front end edge of the arm portion 45, and therefore there is no need to provide a retaining hole or the like exclusively used as such detection member-retaining portion, and the flexible lock arm 41 is prevented from becoming complicated in construction, thereby enhancing its moldability.

When the fitting detection member 60 is located in the initial position, the rear end of the extension portion 65 of this fitting detection member 60 clearly projects beyond the rear end of the female connector 40. When this fitting detection member 60 is located in the proper fitting detection position, the rear end of this extension portion lies substantially flush with the rear end of the female connector 40. Therefore, at the time of the maintenance and inspection or others, whether the fitting detection member 60 is disposed in the initial position or in the proper fitting detection position can be easily judged by confirming with the eyes whether or not the rear end of the extension portion 65 is projected. Therefore, the operation for confirming the position of the fitting detection member at the time of the maintenance and inspection or others can be easily effected.

The different colors are applied respectively to the outer surface of the fitting detection member 60 and the outer surface of the female connector 40, exposed from the fitting detection member 60, so that the appearance, obtained when the fitting detection member 60 is disposed in the initial position, is clearly different in color from the appearance obtained when the fitting detection member 60 is disposed in the proper fitting detection position. Therefore, at the time of the maintenance and inspection or others, whether or not the fitting detection member 60 is disposed in the initial position or in the proper fitting detection position can be easily judged by viewing the color pattern formed by the female connector 40 and the fitting detection member 60, and therefore the operation for confirming the position of the fitting detection member 60 at the time of the maintenance and inspection or others can be easily effected.

In this embodiment, in order to facilitate the operation for confirming the position of the fitting detection member at the time of the maintenance and inspection or others, there are provided the above two means, that is, the provision of the extension portion 65 at the fitting detection member 60 and the application of the different colors to the fitting detection member 60 and the female connector 40. However, only one of these means may be used.

Figure 7:
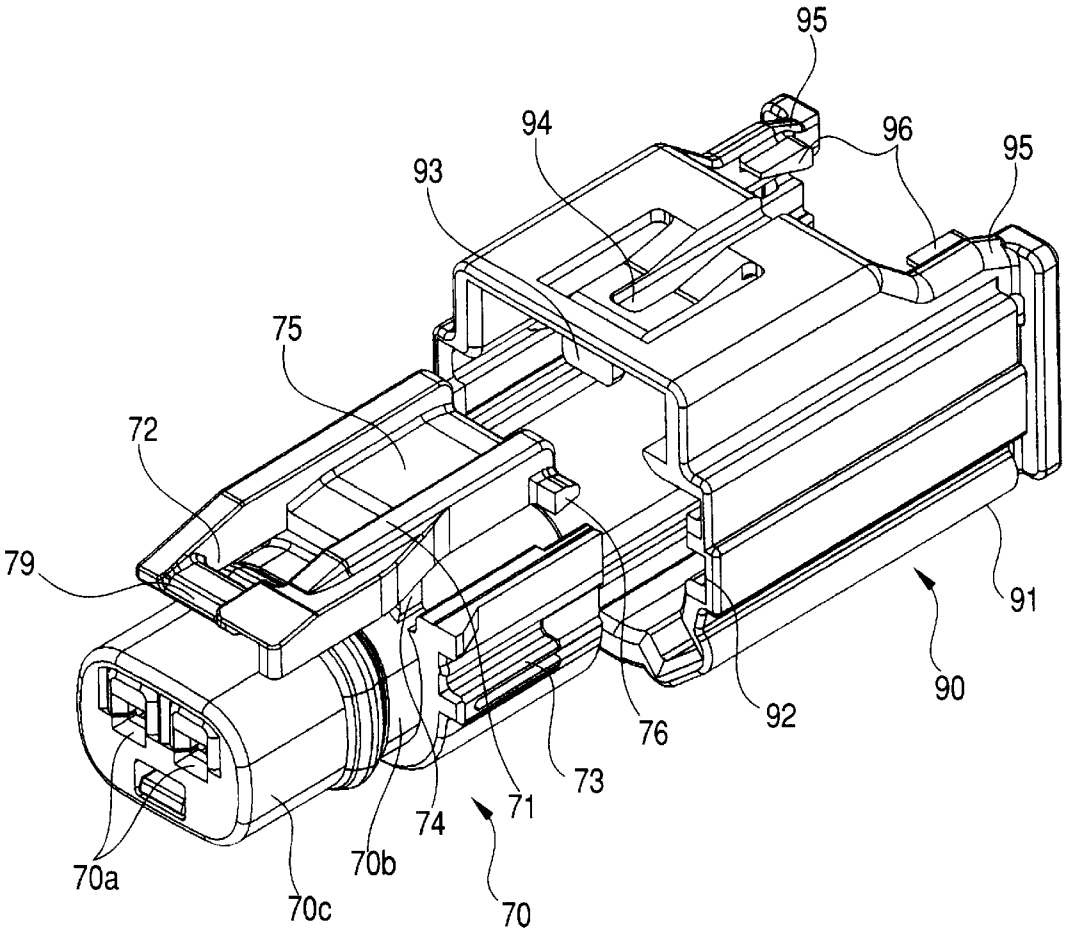
FIG. 7 is an exploded, perspective view showing a female connector housing and a fitting detection member in a second embodiment of a half-fitting prevention connector of the invention.
Figure 9:
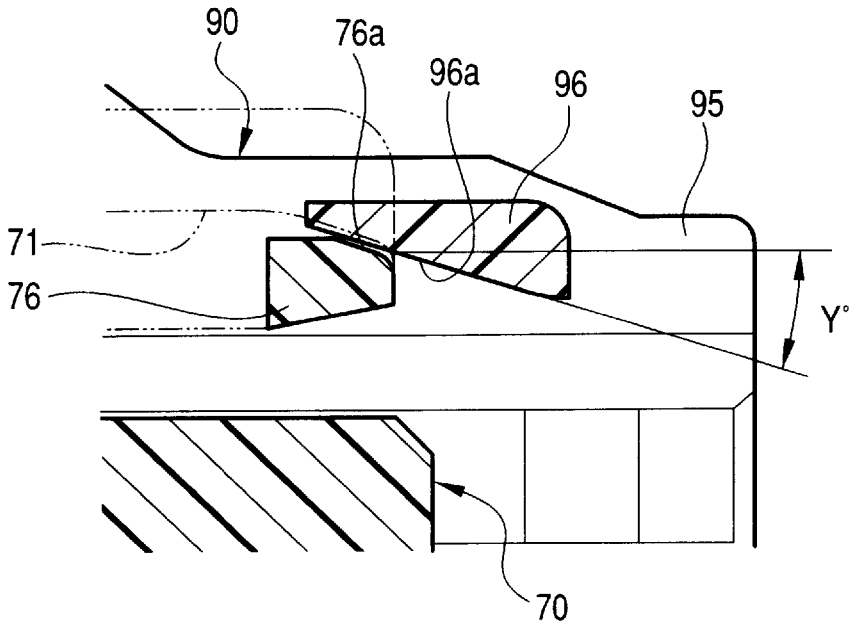
FIG. 9 is a fragmentary, vertical cross-sectional view in FIG. 8.
Figure 10:
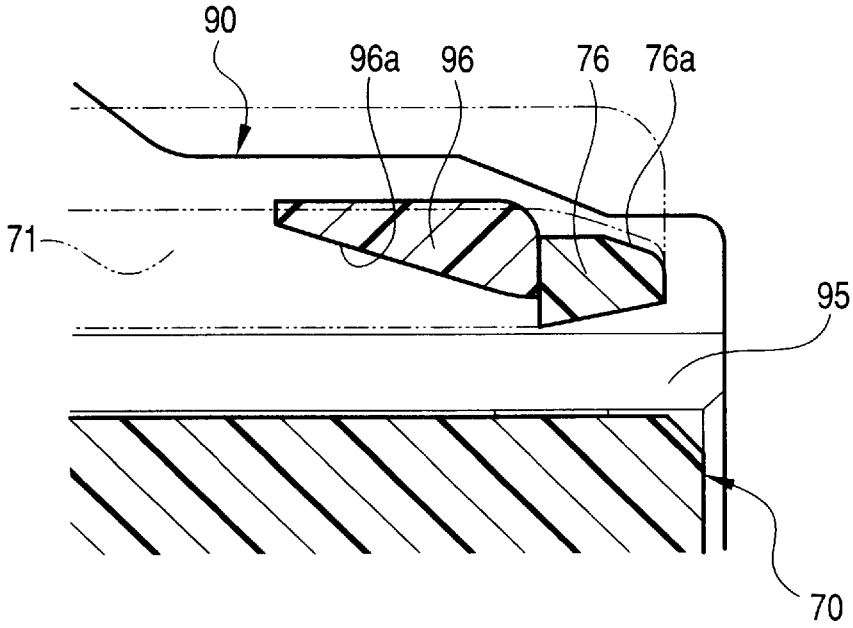
FIG. 10 is a fragmentary, vertical cross-sectional view showing a completely-fitted condition of the female and male connector housings in FIG. 8.

Next, a second embodiment of a half-fitting prevention connector of the present invention will be described with reference to FIGS. 7 to 10. FIG. 7 is an exploded, perspective view showing a female connector housing and a fitting detection member in the second embodiment of the half-fitting prevention connector of the invention, FIG. 8 is a vertical cross-sectional view showing a condition in which the female and male connector housings of the second embodiment are in the process of being fitted together, FIG. 9 is a fragmentary, vertical cross-sectional view in FIG. 8, and FIG. 10 is a fragmentary, vertical cross-sectional view showing a completely-fitted condition of the female and male connector housings in FIG. 8.

Detailed explanation of those members, identical in construction to those of the first embodiment, will be omitted.

Figure 8:
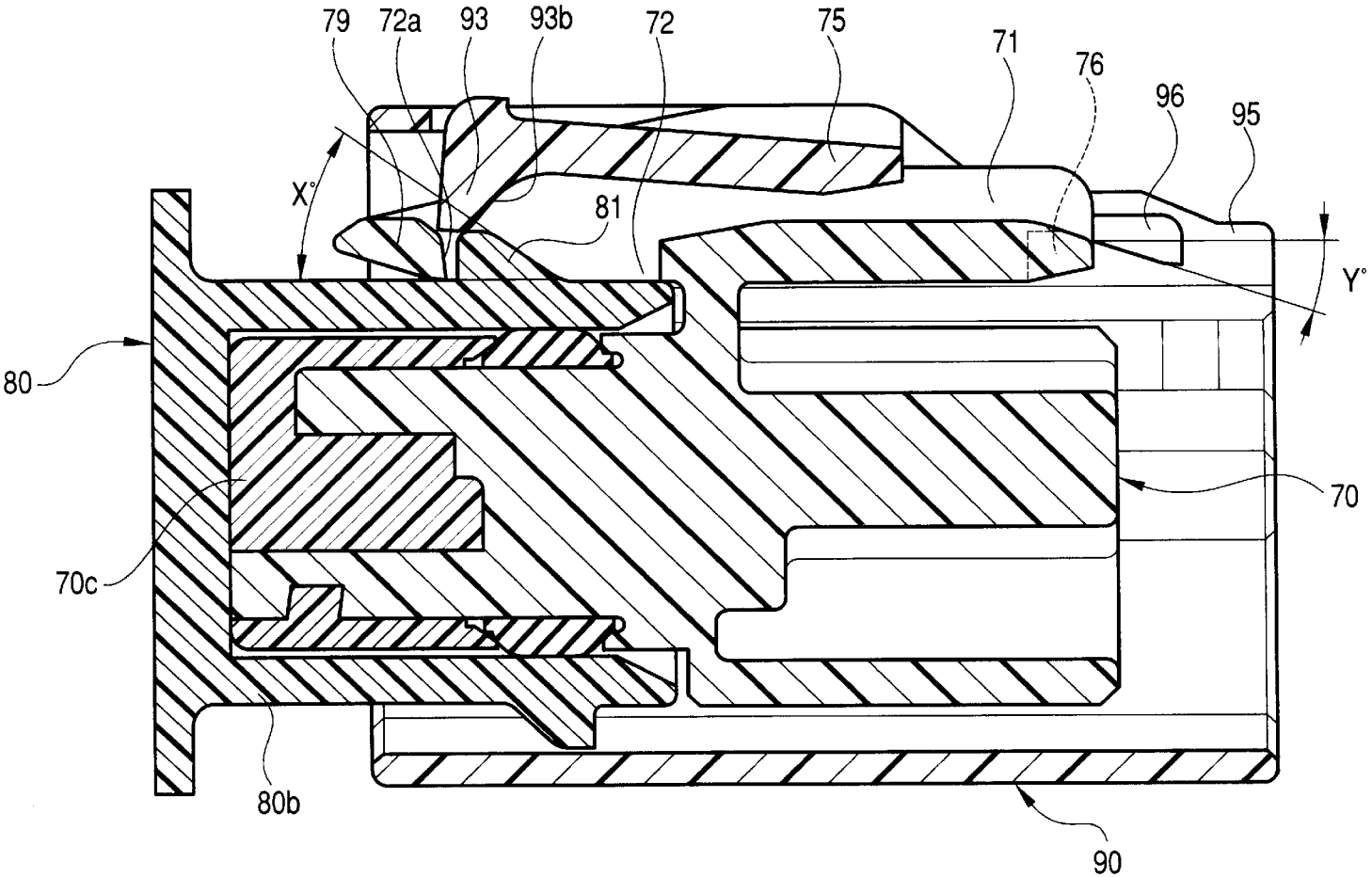
FIG. 8 is a vertical cross-sectional view showing a condition in which the female and male connector housings of the second embodiment are in the process of being fitted together.

As shown in FIGS. 7 and 8, the half-fitting prevention connector of this embodiment comprises a female connector (first connector housing) 70, having a flexible lock arm 71, a male connector (second connector housing) 80 having an engagement projection (engagement portion) 81 for engagement in a retaining hole 72 (serving as a lock portion) formed in the flexible lock arm 71, and the fitting detection member 90 mounted on the female connector 70 so as to slide in a fitting direction.

The female connector 70 of this embodiment includes a housing body 70*b*, having terminal receiving chambers 70*a* for respectively receiving and holding female connection terminals (not shown), the flexible lock arm 71, formed on an upper surface of the housing body, and guide portions 73 for slidably supporting the fitting detection member 90, these portions being molded integrally with one another. A front holder 70*c* is mounted on a front end portion of the housing body 70*b*, and forms the terminal receiving chambers 70*a* continuous with the housing body 70*b*.

The flexible lock arm 71 includes an arm portion 75 formed on upper ends of support post portions 74 formed on a substantially central portion of the upper surface of the housing body 70*b*, and the arm portion 75 extends in a forward-rearward direction relative to the housing body 70*b*, and can be elastically displaced upward and downward on the support post portions 74 serving as a fulcrum.

In the flexible lock arm 71, the retaining hole 72 is formed through that portion of the arm portion 75 disposed near to the front end thereof. Retaining projections 76, serving as second retaining mechanism, are formed respectively on opposite side surfaces of the arm portion 75 at a rear end thereof. Each of this retaining projections 76 has a tapering surface 76*a* (see FIG. 9) for sliding contact with a retaining piece portion 96 during the movement of the fitting detection member 90.

The male connector 80 of this embodiment is analogous in construction to the male connector 50 of the first embodiment, and the engagement projection 81 for engagement in the retaining hole 72 is formed on an upper surface of a housing body 80*b*.

The fitting detection member 90 of this embodiment includes a detection member body 91 of a substantially tubular shape, which is fitted on the outer periphery of the female connector 70 so as to slide in the fitting direction of the female and male connectors 70 and 80 together, and covers the outer periphery of the hosing body 70*b*, and a retaining projection 93 (serving as a positioning retaining portion (first retaining mechanism)) for engagement in the retaining hole 72 to hold the detection member body 91 in an initial position. Guide grooves 92 for slidably fitted respectively on the guide portions 73 are formed respectively in inner side surfaces of the detection member body 91, and this detection member body is mounted on the female connector 40 so as to slide in the fitting direction of the female and male connectors 70 and 80 through the guide portions 73 fitted respectively in the guide grooves 92. Before the female and male connectors 70 and 80 are fitted together, the fitting detection member 90 is engaged with the retaining hole 72, and therefore is held in the initial position. A half-fitted condition of the female and male connectors 70 and 80 can be detected by determining whether or not the fitting detection member 90 can be slid into a proper fitting detection position.

The retaining projection 93 is formed on and projects from a lower surface of a retaining arm (resilient piece portion) 94, which is part of an upper wall of the detection member body 91, at a front end thereof, and when the retaining arm 94 is resiliently displaced upwardly, this retaining projection 93 is displaced upwardly together with the retaining arm 94. This retaining projection 93 is fitted into the retaining hole 72 from the upper side, with its front end surface held against a front end surface 72*a* of the retaining hole 72, thereby holding the fitting detection member 90 in its initial position.

In this embodiment, the proper fitting detection position, to which the fitting detection member 90 is slid, is set at a position which is nearer relative to the front end of the female connector 70 than the initial position (where the retaining projection 93 is retained by the retaining hole 72) is. Therefore, the female connector 70 is provided with a detection member-retaining portion (first retaining mechanism) 79 for limiting the sliding movement of the fitting detection member 90 when this fitting detection member 90 is slid from the initial position forwardly to the proper fitting detection position.

The detection member-retaining portion 79 is defined by the front end edge of the arm portion 75 of the flexible lock arm 71, and when the fitting detection member 90 is slid to the proper fitting detection position, this detection member-retaining portion 79 retains a rear end surface 93*b* of the retaining projection 93, thereby locating and fixing the fitting detection member 90 in the proper fitting detection position. At this time, a click feeling is produced upon retaining engagement of the retaining projection 93 with the detection member-retaining portion 79, and therefore the completely-fitted condition of the female and male connectors 70 and 80 can be detected.

The fitting detection member 90 of this embodiment has an extension portion 95 so that the rear end of this fitting detection member 90, disposed in its initial position, can clearly project beyond the rear end of the housing of the female connector 70, as shown in FIGS. 7 to 9. The retaining piece portions 96 are formed respectively on opposed inner side surfaces of the extension portion 95 at an upper end portion thereof, and project inwardly, and each of these retaining piece portions 96 has a tapering surface 96*a* for sliding contact with the corresponding retaining projection 76 during the movement of the detection member 90.

When this fitting detection member is disposed in the proper fitting detection position, the rear end of this extension portion 95 lies substantially flush with the rear end of the housing of the female connector 70, as shown in FIG. 10. Therefore, the position of this extension portion 95 relative to the female connector 70 in the initial position of the fitting detection member 90 is different from the position of the extension portion 95 relative to the female connector 70 in the proper fitting detection position of the fitting detection member 90, and therefore the appearance is clearly changed, so that the fitted condition of the female and male connectors 70 and 80 can be easily detected.

As described for the first embodiment, different colors are applied respectively to the outer surface of the fitting detection member 90 of this embodiment and the outer surface of the housing of the female connector 70, exposed from the fitting detection member 90, so that the appearance, obtained when the fitting detection member 90 is disposed in the initial position relative to the female connector 70, is clearly different in color from the appearance obtained when the fitting detection member 90 is disposed in the proper fitting detection position.

Therefore, at the time of the maintenance and inspection or others, whether or not the fitting detection member is disposed in the initial position or in the proper fitting detection position can be easily judged by viewing the color pattern formed by the female connector 70 and the fitting detection member 90.

In the operation for fitting the female and male connectors 70 and 80 together, the fitting length of the two housings reaches a predetermined value, and the engagement projection 81 of the male connector 80 is fitted into the retaining hole 72 from the lower side of the arm portion 75, as shown in FIG. 8. By the engagement of the engagement projection 81 in the retaining hole 72, the female and male connectors 70 and 80 are locked in the fitted condition.

At this time, the retaining projection 93 of the fitting detection member 90, already engaged in the retaining hole 72, is pushed upwardly out of this retaining hole by the engagement projection 81, thereby canceling the holding of the fitting detection member 90 in the initial position. Therefore, the fitting detection member 90 can be moved toward the front side of the housing of the female connector 70.

When the fitting detection member 90 is disposed in the initial position, the tapering surfaces 76*a* of the retaining projections 76 are held against the tapering surfaces 96*a* of the retaining piece portions 96, respectively, as shown in FIG. 9. After the housing-fitting operation is completed, the operation for moving the fitting detection member 90 is effected in order to detect the fitted condition of the female and male connectors 70 and 80, and therefore the fitting detection member 90 is slidingly moved forward. In accordance with this sliding movement, the retaining piece portions 96 move forward, with each tapering surface 96*a* sliding on the corresponding tapering surface 76*a*, and the rear portion of the flexible lock arm 71 is displaced downwardly.

When each retaining piece portion 96 slides over the corresponding retaining projection 76, the retaining projection 76 is displaced upwardly by the resilient force of the flexible lock arm 71, so that the front end surface of the retaining projection 76 is abutted against (or engaged with) the rear end surface of the retaining piece portion 96, as shown in FIG. 10. At this time, the fitting detection member 90 is located in the proper fitting detection position, and the rear end of the fitting detection member 90 lies substantially flush with the rear end surface of the female connector 70. Therefore, the fitted condition of the female and male connectors 70 and 80 can be easily detected.

When the detection member-moving operation is completed, the fitting detection member 90 is located in the proper fitting detection position by the retaining engagement of the detection member-retaining portion 79 with the rear end surface 93*b* of the retaining projection 93 as described above for the first embodiment (see FIG. 6).

Therefore, with respect to the retaining device for retaining the female connector 70 and the fitting detection member 90 relative to each other, the retaining is effected at the two portions, that is, by the retaining engagement of the retaining projections 76 with the respective retaining piece portions 96 and the retaining engagement of the detection member-retaining portion 79 with the retaining projection 93. Therefore, the female connector 70 and the fitting detection member 90 can be more firmly retained relative to each other.

The pushing direction in the detection member-moving operation is the same as that in the housing-fitting operation, and therefore by the pushing operation for effecting the housing-fitting operation, the operation, including the detection member-moving operation, can be completed at a time, and the number of the operations, required for connecting the female and male connectors together, can be reduced. And besides, the first and second retaining mechanisms are disposed at the upper surface, and the retained condition can be confirmed with the eyes, and the fitted condition of the female and male connectors can be detected with the eyes.

As shown in FIGS. 8 and 9, an inclination angle Y° of sliding contact of the tapering surface 96*a* of the retaining piece portion 96 with the tapering surface 76*a* of the retaining projection 76 (when the engagement projection 76 engages the retaining piece portion 96) is smaller than an inclination angle X° of sliding contact of the arm portion 75 with the engagement projection 81 (when the engagement projection 81 of the male connector 80 is fitted into the retaining hole 72 from the lower side of the arm portion) (X°>Y°). Therefore, the inserting force, required for the retaining projection 76 to slide over the retaining piece portion 96 to be engaged therewith, is smaller than the inserting force required for the engagement projection 81 to become engaged in the retaining hole 72. Therefore, the operation for moving the detection member 90 can be completed by a pushing force of inertia produced when fitting the female and male connectors 70 and 80 together, and the operation for fitting the female and male connectors 70 and 80 together and the operation for moving the detection member 90 can be effected successively with one pushing operation.

Then, when the operation is shifted from the detection member-moving operation to the housing-pulling confirmation operation, this can be carried out smoothly without the need for changing the positions of the fingers holding the detection fitting member 90 as described above for the first embodiment.

When the rear end of the arm portion 75 is pressed down in the fitted condition of the female and male connectors 70 and 80 in which the engagement projection 81 of the male connector 80 is fitted in the retaining hole 72, the front end of the arm portion 75 is displaced upwardly, thereby canceling the engagement of the engagement projection 81 in the retaining hole 72, and at the same time the rear end of the arm portion 75 is displaced downwardly, thereby canceling the engagement of each retaining projection 76 with the retaining piece portion 96.

And besides, the first and second retaining mechanisms are disposed at the upper surface, and therefore the operation for canceling the retained condition of the retaining mechanisms can be effected while confirming it with the eyes, and therefore the good cancellation operability is obtained.

Figure 11:
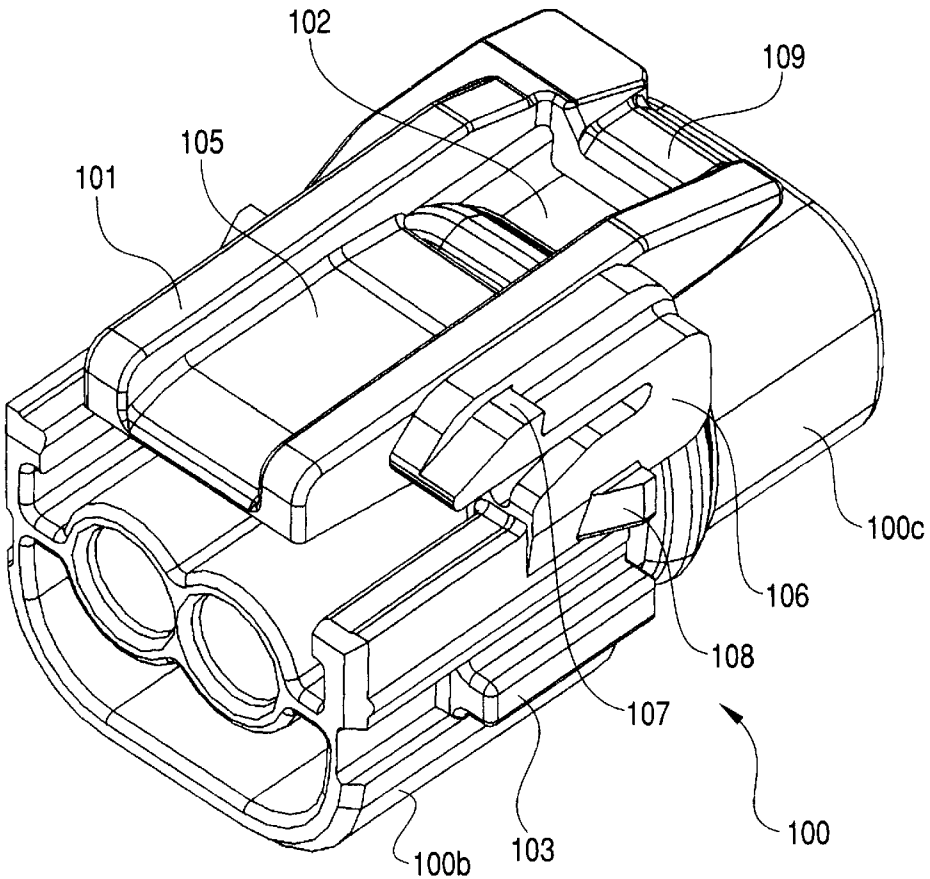
FIG. 11 is a perspective view showing a female connector housing in a third embodiment of a half-fitting prevention connector of the invention.
Figure 13:
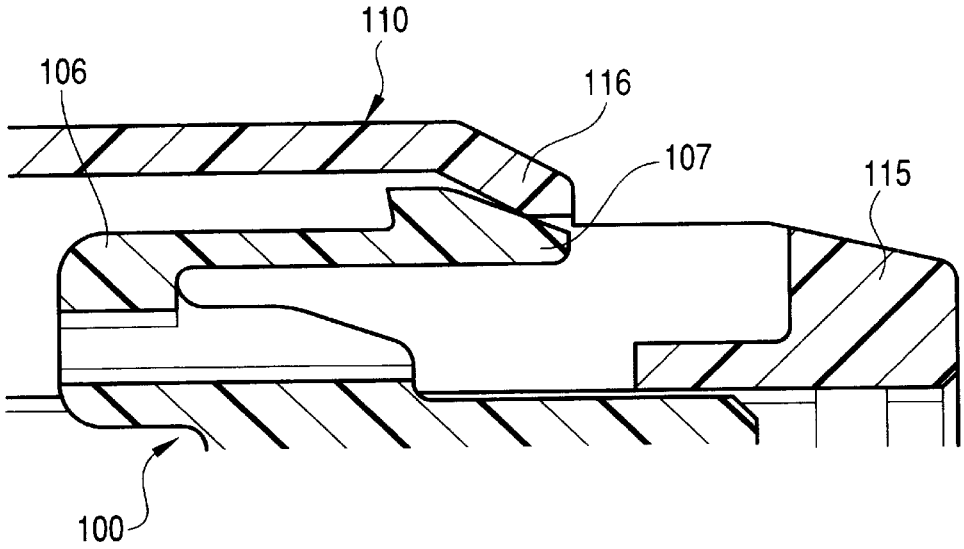
FIG. 13 is a fragmentary, vertical cross-sectional view showing a condition in which the fitting detection member of FIG. 12, fitted on the female connector housing of FIG. 11, is disposed in an initial position.
Figure 14:
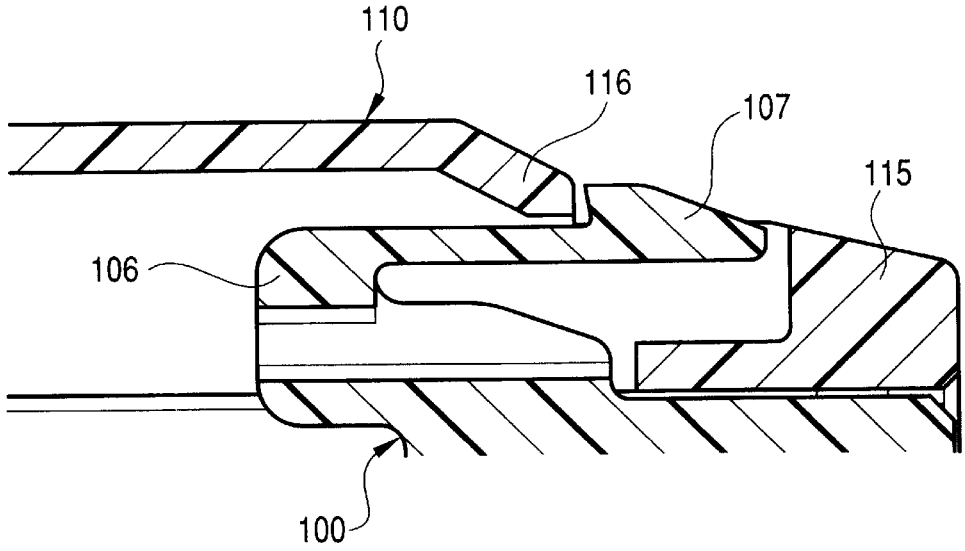
FIG. 14 is a fragmentary, vertical cross-sectional view showing a completely-fitted condition of the female and male connector housings in FIG. 13.

Next, a third embodiment of a half-fitting prevention connector of the present invention will be described with reference to FIGS. 11 to 14. FIG. 11 is a perspective view showing a female connector housing in the third embodiment of the half-fitting prevention connector of the invention, FIG. 12 is a perspective view showing a fitting detection member of the third embodiment, FIG. 13 is a fragmentary, vertical cross-sectional view showing a condition in which the fitting detection member of FIG. 12, fitted on the female connector housing, is disposed in an initial position, and FIG. 14 is a fragmentary, vertical cross-sectional view showing a completely-fitted condition of the female and male connector housings in FIG. 13.

Detailed explanation of those members, identical in construction to those of the first embodiment, will be omitted.

Figure 12:
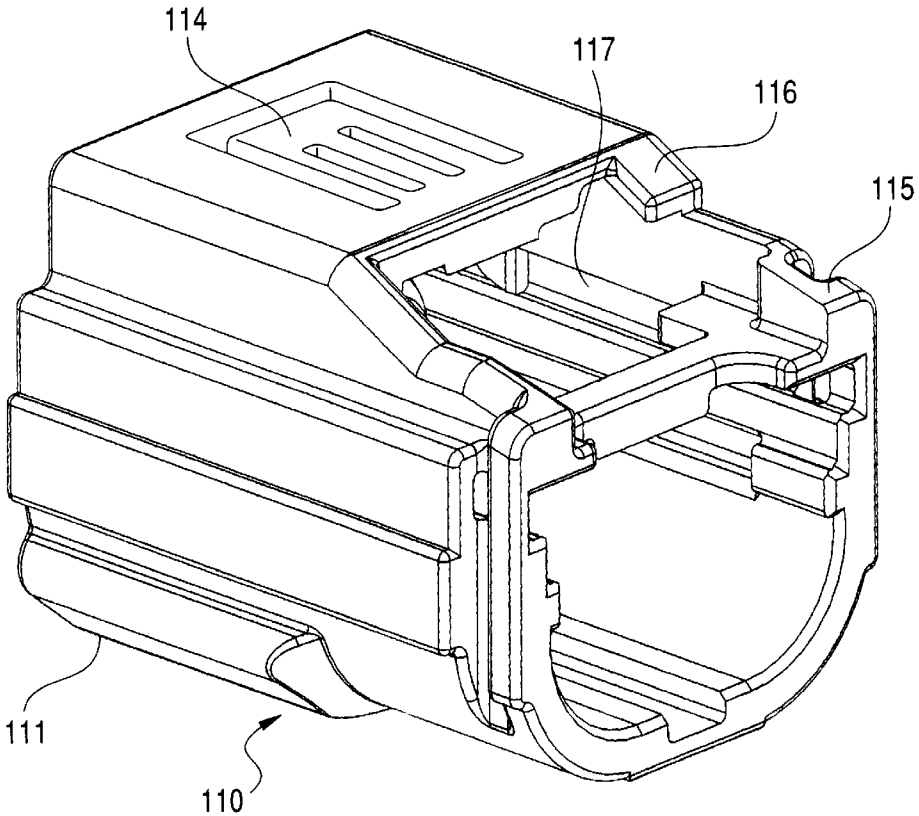
FIG. 12 is a perspective view showing a fitting detection member of the third embodiment.

As shown in FIGS. 11 and 12, the half-fitting prevention connector of this embodiment comprises a female connector (first connector housing) 100, having a flexible lock arm 101, a male connector (second connector housing) (not shown) for connection to the female connector 100, and the fitting detection member 110 slidably mounted on the female connector 100, and a half-fitted condition of the female and male connector housings is detected by determining whether or not this fitting detection member can be slid.

The female connector 100 of this embodiment includes a housing body 100*b*, having terminal receiving chambers (not shown), the flexible lock arm 101, formed on an upper surface of the housing body 100*b*, guide portions 103 for slidably supporting the fitting detection member 110 (described later), and a detection member-retaining arm 106, these portions being molded integrally with one another. A front holder 100*c* is mounted on a front end portion of the housing body 100*b*, and forms the terminal receiving chambers continuous with the housing body 100*b*.

The flexible lock arm 101 includes an arm portion 105 formed on upper ends of support post portions (not shown) formed on a substantially central portion of the upper surface of the housing body 100*b*, and the arm portion 105 extends in a forward-rearward direction relative to the housing body 100*b*, and can be elastically displaced upward and downward on the support post portions serving as a fulcrum. A retaining hole 102 is formed through that portion of the arm portion 105 disposed near to the front end thereof.

The detection member-retaining arm (second retaining mechanism) 106 for engagement with a retaining wall 116 of the fitting detection member 110 (described later) is disposed adjacent to one side of the flexible lock arm 101, and is formed on and projects from a side portion of the housing body 100*b* in an upstanding manner. An engaging claw 107 is formed on an upper surface of this detection member-retaining arm 106 at a rear end thereof. This engaging claw 107 can engage the retaining wall 116 (described later) to limit the rearward movement of the fitting detection member 110. A guide projection 108 for being slidably fitted in a guide groove 117 in the fitting detection member 110 (described later) is formed on the side surface of the detection member-retaining arm 106.

Although not shown in the drawings, the male connector (second connector) of this embodiment is analogous in construction to the male connectors 50 and 80 of the first and second embodiments, and an engagement projection for engagement in the retaining hole 102 is formed on an upper surface of a housing body of this male connector.

The fitting detection member 110 of this embodiment includes a retaining arm 114 which is part of an upper wall of a detection member body 111, and a retaining projection (not shown), serving as a positioning retaining portion (first retaining mechanism) for engagement in the retaining hole 102 to hold the detection member body 111 in the initial position, is formed on a lower surface of the retaining arm 114 at a front end thereof.

The retaining wall (second retaining mechanism) 116 for retaining the engaging claw 107 of the female connector 100 is formed at a rear end of the upper wall of the detection member body 111, and is slanting downwardly in the rear. The detection member body 111 is slidably mounted on the female connector 100, and a half-fitted condition of the female and male connectors can be detected by determining whether or not the fitting detection member 110 can be slid into a proper fitting detection position.

In this embodiment, the proper fitting detection position is set at a position which is nearer relative to the front end of the female connector 100 than the initial position (where the retaining projection is retained by the retaining hole 102) is, as described above for the first and second embodiments. Therefore, the female connector 100 is provided with a detection member-retaining portion (retaining device) 109 for limiting the sliding movement of the fitting detection member 110 when this fitting detection member 110 is slid from the initial position forwardly to the proper fitting detection position.

As shown in FIG. 13, the fitting detection member 110 of this embodiment has an extension portion 115 so that the rear end of this fitting detection member 110, disposed in its initial position, can clearly project beyond the rear end of the housing of the female connector 100. The extension portion 115 has an inwardly-projected shape so that the female connector 100 will not move rearwardly beyond the rear end of the fitting detection member in the completely-fitted condition.

In this embodiment, when the fitting length of the two housings reaches a predetermined value in the operation for fitting the female and male connectors together, the engagement projection of the male connector is fitted into the retaining hole 102, so that the fitted condition of the male and female connectors are locked in the fitted condition. At this time, the holding of the fitting detection member 110 in the initial position is canceled, and therefore the fitting detection member can be moved forward.

After the housing-fitting operation is completed, the operation for moving the fitting detection member 110 is effected in order to detect the fitted condition of the female and male connectors, and therefore the fitting detection member 110 is slidingly moved forward. In accordance with this sliding movement, the retaining wall 116 moves forward (in a left-hand direction in FIG. 13) in sliding contact with the engaging claw 107, and elastically deforms the detection member-retaining arm 106 downwardly.

When the retaining wall 116 slides over the engaging claw 107, the engaging claw 107 is displaced upwardly by the resilient force of the detection member-retaining arm 106, so that the front end surface of the engaging claw 107 is abutted against (or engaged with) the rear end surface of the retaining wall 116, as shown in FIG. 14. At this time, the fitting detection member 110 is located in the proper fitting detection position, and the rear end of the fitting detection member 110 lies substantially flush with the rear end surface of the female connector 100. Therefore, the fitted condition of the female and male connectors can be easily detected.

When the detection member-moving operation is completed, the fitting detection member 110 is located in the proper fitting detection position by the retaining engagement of the detection member-retaining portion 109 with the rear end surface of the retaining projection as described above for the first and second embodiments.

Therefore, with respect to the retaining device for retaining the female connector 100 and the fitting detection member 110 relative to each other, the retaining is effected at the two portions, that is, by the retaining engagement of the engaging claw 107 with the retaining wall 116 and the retaining engagement of the detection member-retaining portion 109 with the rear end surface of the retaining projection. Therefore, the female connector 100 and the fitting detection member 110 can be more firmly retained relative to each other.

And besides, the first and second retaining mechanisms are disposed at the upper surface, and therefore the retained condition can be confirmed with the eyes, and the fitted condition of the female and male connectors can be detected with the eyes.

The pushing direction in the detection member-moving operation is the same as that in the housing-fitting operation, and therefore by the pushing operation for effecting the housing-fitting operation, the operation, including the detection member-moving operation, can be completed at a time, and the number of the operations, required for connecting the female and male connectors together, can be reduced.

Then, when the operation is shifted from the detection member-moving operation to the housing-pulling confirmation operation, this can be carried out smoothly without the need for changing the positions of the fingers holding the detection fitting member 110.

For canceling the retaining engagement of the engaging claw 107 with the retaining wall 116, the engaging claw 107 is pressed down, and then the fitting detection member 110 is slidingly moved rearward.

And besides, the first and second retaining mechanisms are disposed at the upper surface, and therefore the operation for canceling the retained condition of the retaining mechanisms can be effected while confirming it with the eyes, and therefore the good cancellation operability is obtained.

Figure 15:
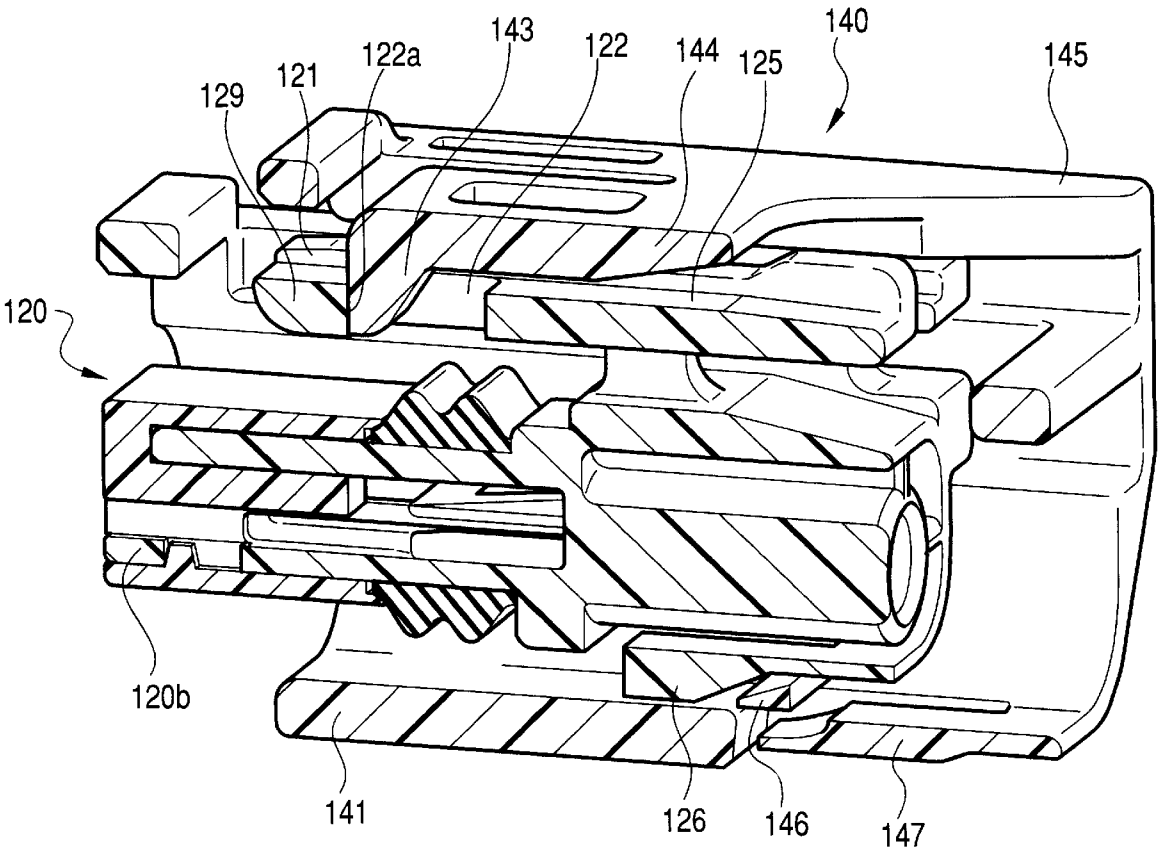
FIG. 15 is a vertical cross-sectional view of a fourth embodiment of a half-fitting prevention connector of the invention, showing a condition in which a fitting detection member, fitted on a female connector housing, is disposed in an initial position.

Next, a fourth embodiment of a half-fitting prevention connector of the present invention will be described with reference to FIGS. 15 to 17. FIG. 15 is a vertical cross-sectional view of the fourth embodiment of the half-fitting prevention connector of the invention, showing a condition in which a fitting detection member, fitted on a female connector housing, is disposed in an initial position, FIG. 16 is a perspective view showing a condition in which the fitting detection member is in the process of being slid to a proper fitting detection position, and FIG. 17 is a vertical cross-sectional view showing a completely-fitted condition of the female and male connector housings of FIG. 16.

Detailed explanation of those members, identical in construction to those of the first embodiment, will be omitted.

Figure 16:
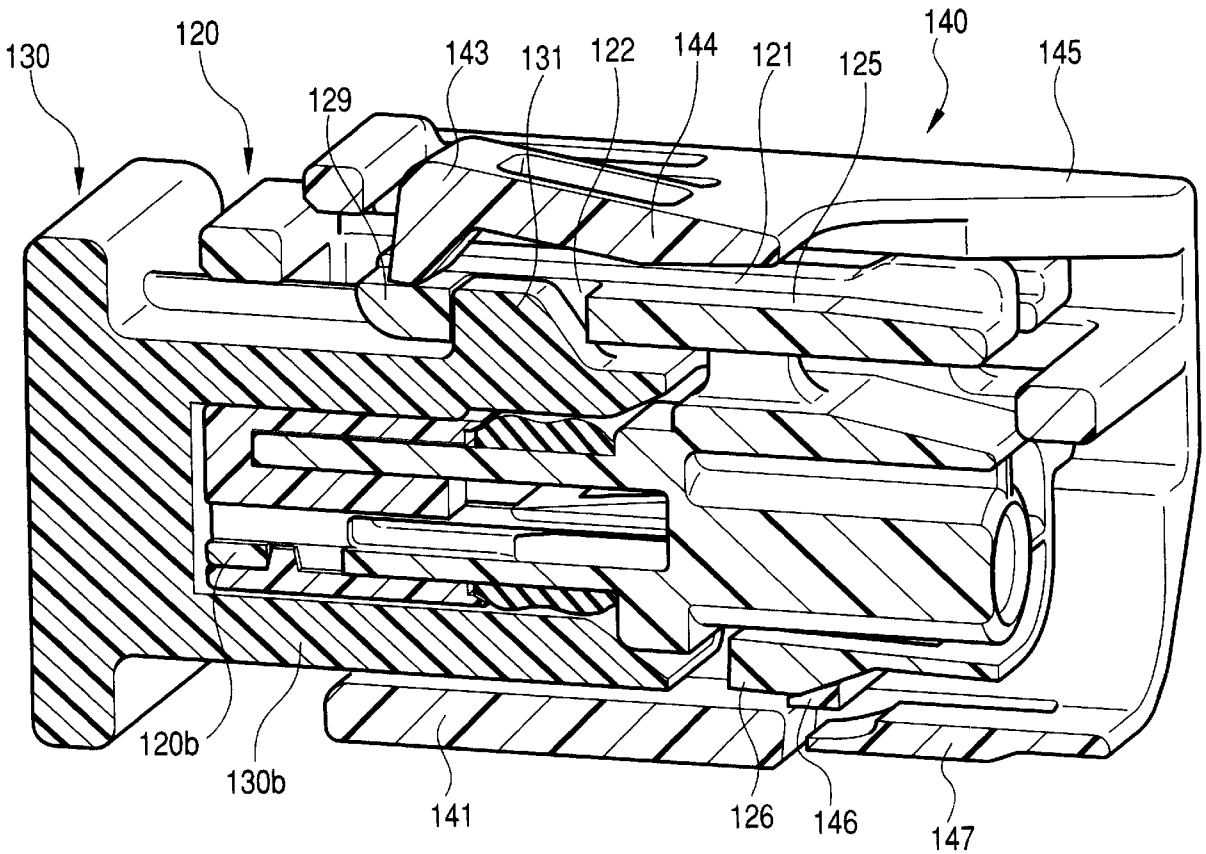
FIG. 16 is a perspective view showing a condition in which the fitting detection member of FIG. 15 is in the process of being slid to a proper fitting detection position.
Figure 17:
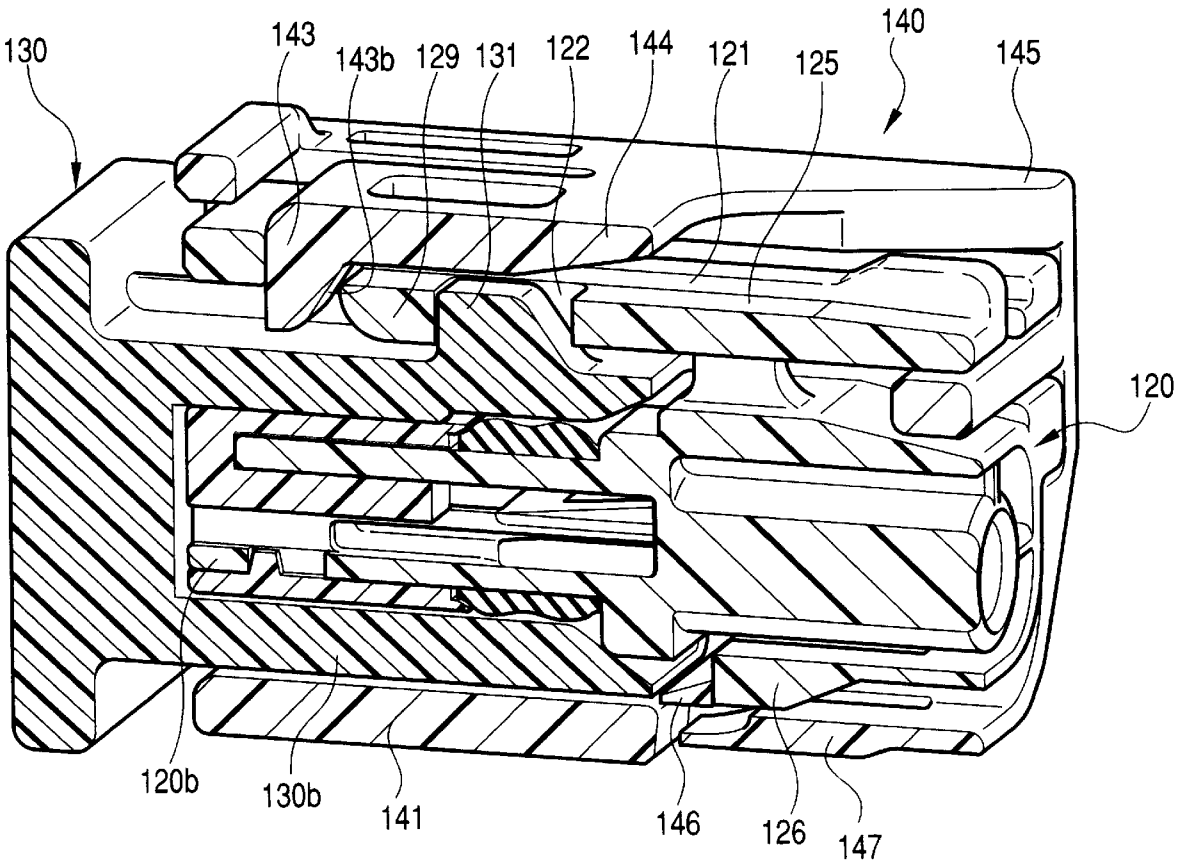
FIG. 17 is a vertical cross-sectional view showing a completely-fitted condition of the female and male connector housings of FIG. 16.
Figure 18:
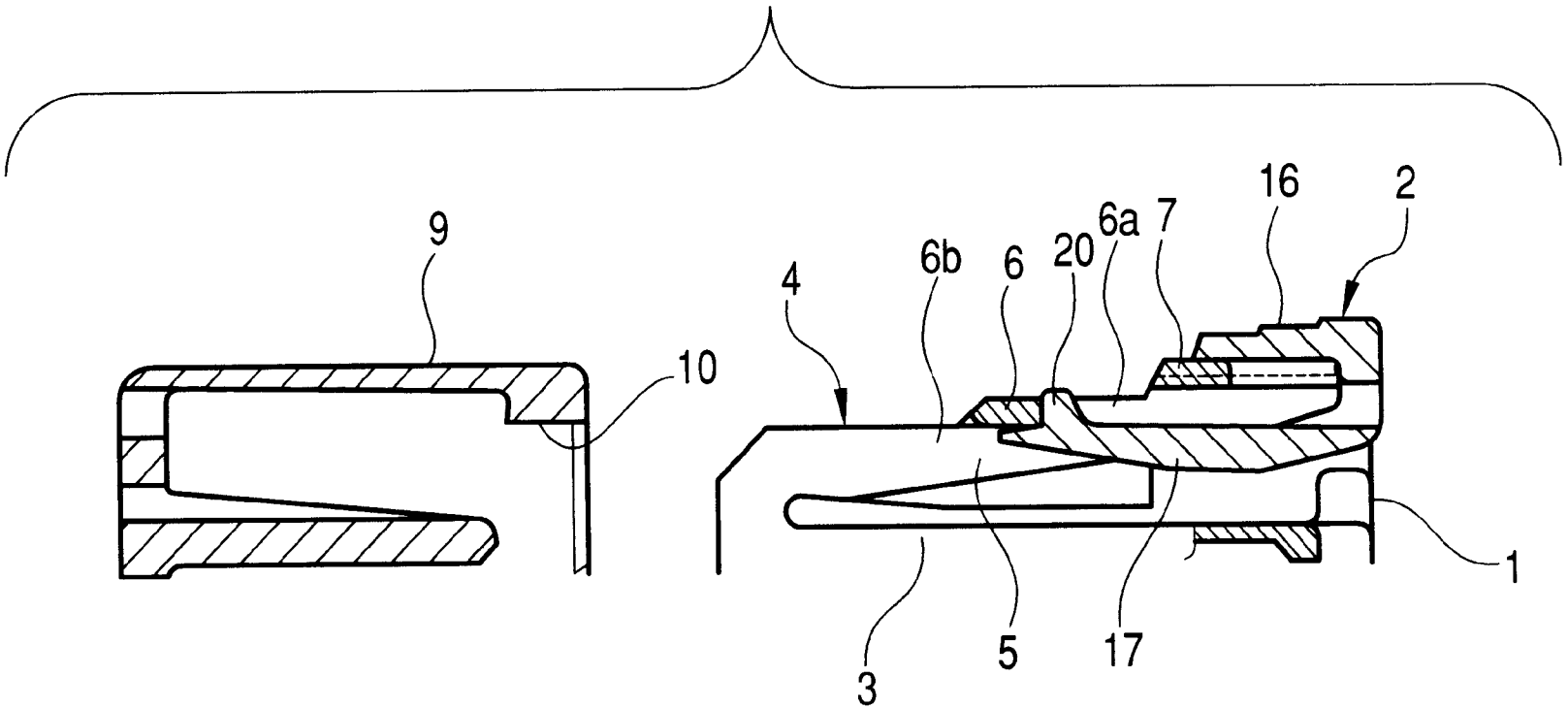
FIG. 18 is a vertical cross-sectional view of a conventional half-fitting connector showing a condition before it is brought into a fitted condition.
Figure 19:
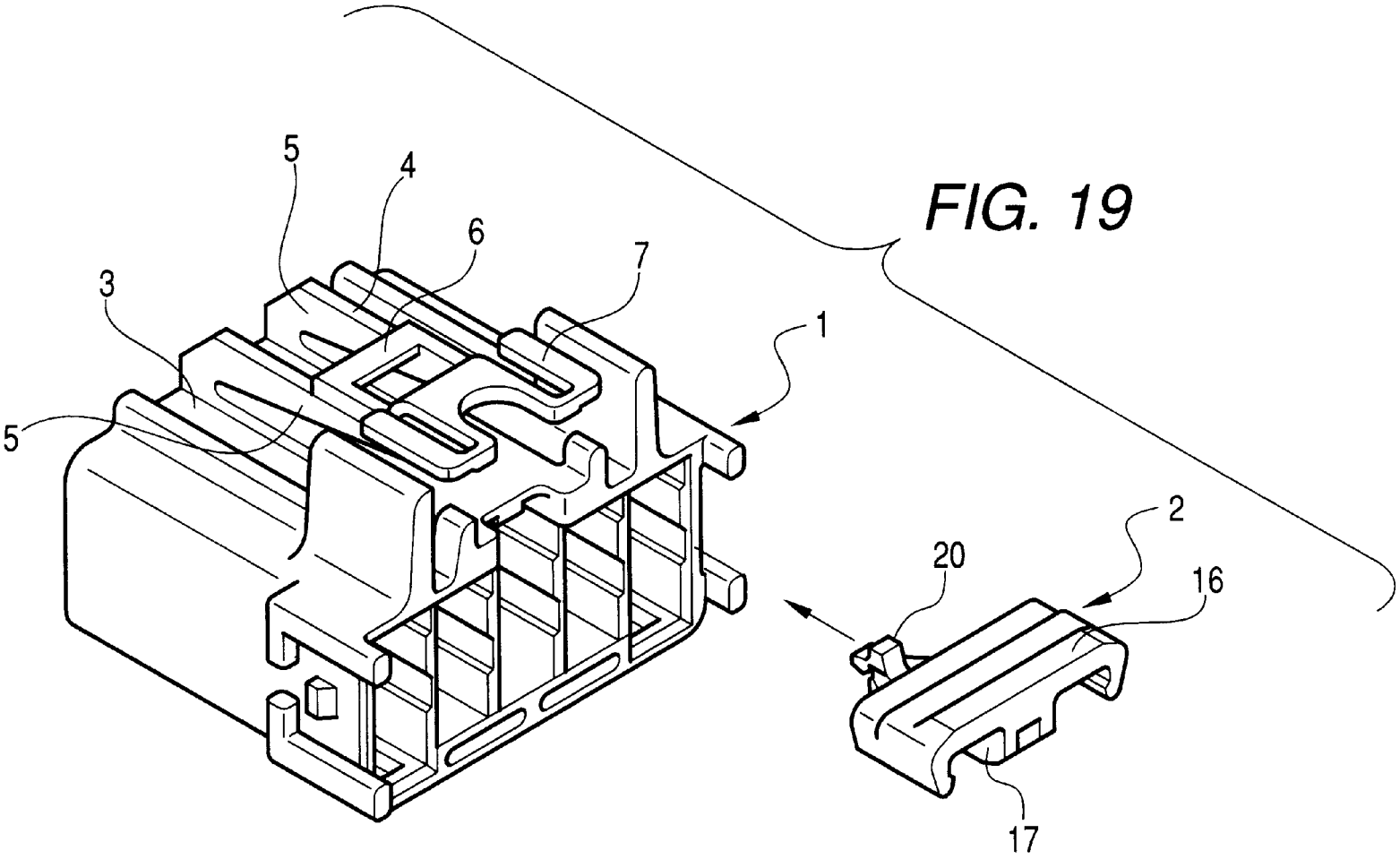
FIG. 19 is an exploded, perspective view showing a male connector housing and a fitting detection member.
Figure 20:
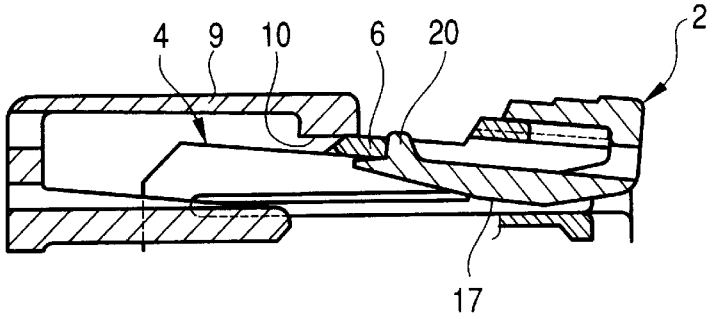
FIG. 20 is a vertical cross-sectional view of an important portion showing a fitting process in FIG. 18.
Figure 21:
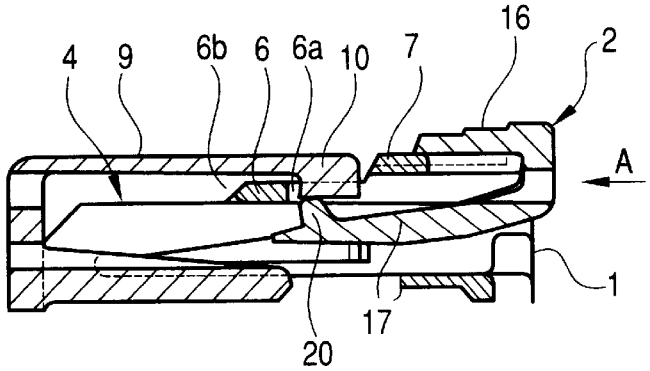
FIG. 21 is a fragmentary, vertical cross-sectional view showing a condition in which an engagement portion of the second connector housing is engaged with a lock portion of first connector housing in FIG. 18.
Figure 22:
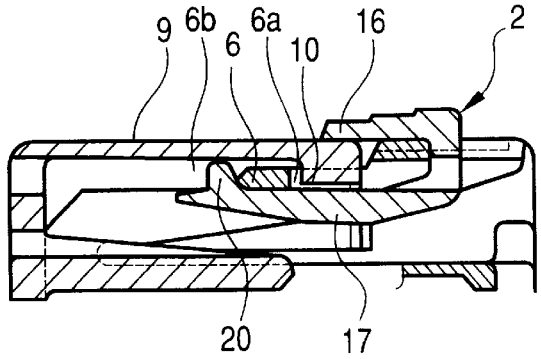
FIG. 22 is a fragmentary, vertical cross-sectional view showing a condition in which the fitting of the two connector housings of FIG. 18 has been completed, and the fitting detection member has been slid into a proper fitting detection position.

As shown in FIGS. 15 to 17, the half-fitting prevention connector of this embodiment is very analogous in construction to the connector of the first embodiment, and comprises the female connector (first connector housing) 120, having a flexible lock arm 121, the male connector (second connector housing) 130 having an engagement projection (engagement portion) 131 for engagement in a retaining hole 122 (serving as a lock portion) formed in the flexible lock arm 121, and the fitting detection member 140 slidably mounted on the female connector 120, and a half-fitted condition of the female and male connector 120 and 130 is detected by determining whether or not this fitting detection member can be slid into the proper fitting detection position.

The half-fitting prevention connector of this embodiment is characterized in that the first projection 48 and the second projection 67 (serving as the retaining mechanism) of the first embodiment are replaced by an elastic retaining portion 126, formed on a bottom surface of the female connector 120 at a rear portion thereof, and a retaining rib 146 extending between inner surfaces of opposite side walls of the fitting detection member 140 at a lower portion thereof. A cancellation arm 147 for canceling the retaining engagement of the elastic retaining portion 126 with the retaining rib 146 is formed at a bottom wall of the fitting detection member 140 at a rear portion thereof.

The elastic retaining portion 126 serves as second retaining mechanism for retaining the female connector 120 and the fitting detection member 140 relative to each other, and comprises a resilient piece portion which is part of a rear bottom wall of a housing body 120*b*, and this elastic retaining portion 126 can be elastically displaced upwardly. When the fitting detection member 140 is slid forwardly from the initial position, a lower slanting surface of the elastic retaining portion 126 is brought into sliding contact with the retaining rib 146, so that the elastic retaining portion 126 is elastically displaced upwardly. The fitting detection member 140 is held in the proper fitting detection position by the retaining engagement of the front end surface of the elastic retaining portion 126 with the retaining rib 146.

The retaining rib 146 serves as the second retaining mechanism for retaining the female connector 120 and the fitting detection member 140 relative to each other, and extends between the opposed inner side surfaces of a fitting detection member body 141, and is disposed slightly above the bottom surface thereof. When the fitting detection member 140 is slid forwardly from the initial position, the retaining rib 146 moves to the front side of the elastic retaining portion 126 while elastically deforming the elastic retaining portion 126 upwardly. When the fitting detection member 140 reaches the proper fitting detection position, the rear end of the retaining rib 146 is abutted against the front end of the elastic retaining portion 126, thereby preventing the forward sliding movement of the female connector 120.

The fitting detection member 140, mounted on the female connector 120, has a retaining projection 143 (serving as a positioning retaining portion (first retaining mechanism)), and before the female and male connectors are fitted together, this retaining projection 143 is fitted in the retaining hole 122, with its front surface abutted against a front end surface 122*a* of the retaining hole 122, to thereby hold the detection member body 140 in the initial position, as shown in FIG. 15. In this condition, an extension portion 145 of the fitting detection member 140 clearly projects beyond the rear end surface of the female connector 120, and therefore the fact that the fitting detection member 140 is disposed in the initial position can be confirmed with the eyes.

In the operation for fitting the male and female connectors 120 and 130 together, the engagement projection 131 of the male connector 130 is fitted into the retaining hole 122 from a lower side of an arm portion 125, as shown in FIG. 16. By this retaining engagement of the engagement projection 131 in the retaining hole 122, the female and male connectors 120 and 130 are locked in the fitted condition.

When the female and male connectors 120 and 130 are completely fitted together, the holding of the fitting detection member 140 in the initial position is canceled, and therefore this fitting detection member can be moved toward the front side of the female connector 120. In this condition, a retaining arm 144 is elastically displaced upwardly, and the fitting detection member 140 is slidingly moved forward. In accordance with the sliding movement of the fitting detection member 140, an upper slanting surface of the retaining rib 146 slides in contact with the lower slanting surface of the elastic retaining portion 126, thereby elastically displacing the elastic retaining portion 126 upwardly.

When the elastic retaining portion 126 slides over the retaining rib 146, this elastic retaining portion 126 is elastically displaced downwardly, so that the rear end surface of the elastic retaining portion 126 is abutted against the retaining rib 146. At this time, the rear end of the fitting detection member 140, located in the proper fitting detection position, lies substantially flush with the rear end surface of the female connector 120. Therefore, the fitted condition of the female and male connectors can be easily detected.

When the detection member-moving operation is completed, the fitting detection member 140 is located in the proper fitting detection position by the retaining engagement of a detection member-retaining portion (first retaining mechanism) 129 with a rear end surface 143*b* of the retaining projection 143.

Therefore, with respect to the retaining device for retaining the female connector 120 and the fitting detection member 140 relative to each other, the retaining is effected at the two portions, that is, by the retaining engagement of the elastic retaining portion 126 with the retaining rib 146 and the retaining engagement of the detection member-retaining portion 129 with the rear end surface 143*b* of the retaining projection 143. Therefore, the female connector 120 and the fitting detection member 140 can be more firmly retained relative to each other.

The pushing direction in the detection member-moving operation is the same as that in the housing-fitting operation, and therefore by the pushing operation for effecting the housing-fitting operation, the operation, including the detection member-moving operation, can be completed at a time, and the number of the operations, required for connecting the female and male connectors together, can be reduced.

Then, when the operation is shifted from the detection member-moving operation to the housing-pulling confirmation operation, this can be carried out smoothly without the need for changing the positions of the fingers holding the detection fitting member 140 as described above for the first embodiment.

For canceling the retaining engagement of the elastic retaining portion 126 with the retaining rib 146, the cancellation arm 147 is pressed upward, and then the fitting detection member 140 is slidingly moved rearward.

As described above, in the half-fitting prevention connector-assembling method of the invention, before the two connector housings are fitted together, the fitting detection member is fitted on the outer periphery of the first connector housing, and is held in the initial position by the engagement of the lock portion with the positioning retaining portion, and in the operation for fitting the two connector housings together, the fitting detection member, mounted on the first connector housing, is pushed toward the front side of the first connector housing in the fitting direction, and as a result, the engagement portion of the second connector housing is brought into engagement with the lock portion of the flexible lock arm, so that the two connector housings are completely fitted together, and as a result of engagement of the engagement portion with the lock portion, the positioning retaining portion is pushed out of the lock portion, thereby canceling the holding of the fitting detection member in the initial position relative to the first connector housing, and subsequently the fitting detection member is slid from the initial position to the proper fitting detection position substantially near to the front end of the first connector housing, and the fitting detection member is held in the proper fitting detection position by the retaining device for holding the fitting detection member in the proper fitting detection position, thereby detecting the completely-fitted condition of the two connector housings.

In this half-fitting prevention connector-assembling method, by pushing the fitting detection member, mounted on the first connector housing, forward in the fitting direction, the two connector housings are completely fitted together, and also the fitting detection member is slid into the proper fitting detection position, and is held in this position. Therefore, the operation for fitting the two connector housings together and the detection member-moving operation can be completed by one pushing operation.

In the half-fitting prevention connector, the fitting detection member includes the detection member body of a substantially tubular shape, which is fitted on the outer periphery of the first connector housing so as to slide in the fitting direction of the two connector housings, and the positioning retaining portion for engagement with the lock portion to hold the detection member body in the initial position, and before the two connector housings are fitted together, the detection member body is held in the initial position by the engagement of the lock portion with the positioning retaining portion, and when the two connector housings are completely fitted together, the positioning retaining portion is pushed out of the lock portion upon engagement of the engagement portion with the lock portion, so that the engagement of the positioning retaining portion with the lock portion is canceled, and the detection member body is slid from the initial position to the proper fitting detection position substantially near to the front end of the first connector housing, and the fitting detection member is held in the proper fitting detection position by retaining device for retaining the first connector housing and the fitting detection member to each other.

In the half-fitting prevention connector of the above construction, the fitting detection member, mounted on the first connector housing, before fitted relative to the second connector housing, is held and retained in the initial position by the lock portion, and substantially covers the outer periphery of the first connector housing. Therefore, when effecting the operation for fitting the pair of female and male connector housings together, this fitting operation can be carried out, with the fitting detection member kept held with the fingers.

After the housing-fitting operation is finished, the detection member-moving operation for moving the fitting detection member from the initial position to the proper fitting detection position is effected in order to detect the fitted condition of the female and male connector housings. At this time, if the fitting detection member is held with the fingers at the time of the housing-fitting operation, the fitting detection member can be moved in the next detection member-moving operation merely by pushing the fitting detection member toward the front side of the housing, without the need for changing the positions of the fingers. Therefore, the number of the operations, required for connecting the two connector housings together, can be reduced.

When the fitting detection member reaches the proper fitting detection position, the positioning retaining portion of the fitting detection member is engaged with the detection member-retaining portion of the first connector housing, thereby limiting the sliding movement of the fitting detection member.

Therefore, in the housing-pulling confirmation operation for pulling the female and male connector housings away from each other, the fitting detection member need only to be pulled toward the rear side of the housing, and there is no need to change the positions of the fingers holding the fitting detection member. Therefore, the number of the operations, required for connecting the two connector housings together, can be reduced, and the efficiency of the operation for connecting the two connector housings together can be enhanced.

In the half-fitting prevention connector of the invention, the fitting detection member has the extension portion which projects beyond the rear end of the first connector housing when the fitting detection member is disposed in the initial position, and is disposed on the outer periphery of the first connector housing when the fitting detection member is disposed in the proper fitting detection position, and the position of the extension portion in the initial position of the fitting detection member is clearly different from the position of the extension portion in the proper fitting detection position of the fitting detection member.

Therefore, at the time of the assembling operation, the maintenance and inspection or others, whether the fitting detection member is disposed in the initial position or in the proper fitting detection position can be easily judged by confirming the position of the extension portion with the eyes.

In the half-fitting prevention connector of the invention, the retaining device includes the first retaining mechanism for retaining the fitting detection member at the front portion of the first connector housing, and the second retaining mechanism for retaining the fitting detection member at the rear portion of the first connector housing.

Therefore, the retaining of the fitting detection member in the proper fitting detection position can be effected at the front and rear portions of the fitting detection member. Therefore, the fitting detection member can be firmly retained in the proper fitting detection position.

In the half-fitting prevention connector of the invention, the first retaining mechanism comprises the positioning retaining portion, and the detection member-retaining portion defined by the front end edge of the flexible lock arm.

Therefore, there is no need to provide a retaining hole or the like exclusively used as the first retaining mechanism, and the first retaining mechanism can be provided by the positioning retaining portion and the detection member-retaining portion defined by the front end edge of the flexible lock arm, and the fitting detection member and the first connector housing can be simplified in construction and shape.

In the half-fitting prevention connector, the second retaining mechanism comprises the first projection, formed on the rear portion of the bottom portion of the first connector housing, and the second projection formed on the bottom portion of the inner peripheral surface of the fitting detection member, or the second retaining mechanism comprises the elastic retaining portion, formed on the rear portion of the bottom portion of the first connector housing, and the retaining rib extending between the inner surfaces of the opposite side walls of the fitting detection member at the lower portion thereof.

Therefore, the retaining of the fitting detection member in the proper fitting detection position can be effected at the upper portion of the front portion of the fitting detection member and the rear portion of the bottom portion thereof, and a relative slight movement or shaking between the fitting detection member and the first connector housing is suppressed, so that the fitting detection member can be more firmly retained.

In the half-fitting prevention connector of the invention, the second retaining mechanism comprises the retaining projections, formed respectively on the opposite side surfaces of the flexible lock arm at the rear end thereof, and the retaining piece portions formed respectively on the opposed inner side surfaces of the fitting detection member at the upper end portion thereof, or the second retaining mechanism comprises the detection member-retaining arm, which is disposed adjacent to one side of the flexible lock arm, and has the engaging claw formed on the upper surface at the rear end thereof, and the retaining wall formed on the rear end of the upper wall of the fitting detection member.

Therefore, the first and second retaining mechanisms are disposed at the upper surface, and therefore the retained condition can be confirmed with the eyes, and the fitted condition of the two connector housings can be confirmed with the eyes. And besides, since the first and second retaining mechanisms are disposed at the upper surface, the operation for canceling the retained condition of the retaining device can be effected while confirming it with the eyes, and therefore the cancellation operability can be enhanced.

In the half-fitting prevention connector of the invention, the fitting detection member is designed such that the inserting force, required when retaining the fitting detection member in the proper fitting detection position by the retaining device, is smaller than the inserting force required for fitting the two connector housings together.

In the half-fitting prevention connector of the invention, the height of engagement between the first and second projections is smaller than the height of engagement between the lock portion and the engagement portion, or the angle of inclination of the tapering surface of the retaining piece portion is smaller than the angle of inclination of the engagement portion.

Therefore, the inserting force, required for the detection member-moving operation, is smaller than the inserting force required for the connector-fitting operation, and therefore the detection member-moving operation can be effected by the pushing force of inertia produced when fitting the two connector housings together. Therefore, the operation for fitting the two connector housings together and the operation for moving the detection member can be effected successively with one pushing operation.

In the half-fitting prevention connector of the invention, the different colors are applied respectively to the outer surface of the fitting detection member and at least that portion of the outer surface of the first connector housing, exposed from the fitting detection member, so that the appearance of the first connector housing, obtained when the fitting detection member is disposed in the initial position, is clearly different in color from the appearance obtained when the fitting detection member is disposed in the proper fitting detection position.

Therefore, at the time of the assembling operation, the maintenance and inspection or others, whether or not the fitting detection member is disposed in the initial position or in the proper fitting detection position can be easily confirmed by viewing the color pattern formed by the first connector housing and the fitting detection member. Therefore, the fitted condition of the pair of female and male connector housings can be easily confirmed at the time of the maintenance and inspection or others.

What is claimed is:

1. A method of assembling a half-fitting prevention connector, said connector including a first connector housing having a flexible lock arm formed on an upper surface of a housing body; a second connector housing having an engagement portion engagable with a lock portion of said flexible lock arm and connected to said first connector housing by the engagement of said lock portion with said engagement portion when said second connector housing is fitted relative to said first connector housing; and a fitting detection member having a positioning retaining portion for engagement with said lock portion and slidably mounted on said first connector housing in a fitting direction of said first and second connector housings, wherein a half-fitted condition of said first and second connector housings is detected by determining whether or not said fitting detection member can be slidingly moved;

said method of assembling comprising the steps of:

holding said fitting detecting member at an initial position by engagement of said lock portion with said positioning retaining portion and fitting of said fitting detection member on an outer periphery of said first connector housing before said first and second connector housings are fitted together;

pushing said fitting detection member mounted on said first connector housing toward a front side of said first connector housing in the fitting direction in an operation for fitting said first and second connector housings together;

completely fitting said first and second connector housings by engaging said engagement portion of said second connector housing with said lock portion of said flexible lock arm;

pushing said positioning retaining portion out of said lock portion, thereby canceling holding of said fitting detection member in the initial position relative to said first connector housing;

sliding said fitting detection member from the initial position to a proper fitting detection position which is nearer to a front end of said first connector housing than the initial position; and holding said fitting detection member in the proper fitting detection position by a retaining device for holding said fitting detection member in the proper fitting detection position, thereby detecting a completely-fitted condition of said first and second connector housings.

2. A half-fitting prevention connector comprising:

a first connector housing having a flexible lock arm formed on an upper surface of a housing body thereof;

a second connector housing having an engagement portion engagable with a lock portion of said flexible lock arm to thereby be connected to said first connector housing when said second connector housing is fitted relative to said first connector housing; and a fitting detection member mounted on said first connector housing so as to slide in a fitting direction of said first and second connector housings for detecting a half-fitted condition of said first and second connector housings by determining whether or not said fitting detection member can be slidingly moved, said fitting detection member including a detection member body of a substantially tubular shape fitted on an outer periphery of said first connector housing so as to slide in the fitting direction of said first and second connector housings and a positioning retaining portion for engagement with said lock portion to hold said detection member body in an initial position;

wherein said detection member body is held in the initial position by the engagement of said lock portion with said positioning retaining portion before said first and second connector housings are fitted together;

said positioning retaining portion is pushed out of said lock portion upon engagement of said engagement portion with said lock portion, so that the engagement of said positioning retaining portion with said lock portion is canceled, when said first and second connector housings are completely fitted together;

said detection member body is slid from the initial position to a proper fitting detection position near to a front end of said first connector housing; and said fitting detection member is held in the proper fitting detection position by a retaining device for retaining said first connector housing and said fitting detection member to each other.

3. A half-fitting prevention connector according to claim 2, said fitting detection member including an extension portion which projects beyond a rear end of said first connector housing when said fitting detection member is disposed in the initial position, and is disposed on the outer periphery of said first connector housing when said fitting detection member is disposed in the proper fitting detection position;

wherein a position of said extension portion in the initial position of said fitting detection member is different from a position of said extension portion in the proper fitting detection position of said fitting detection member.

4. A half-fitting prevention connector according to claim 2, wherein different colors are applied respectively to an outer surface of said fitting detection member and at least that portion of an outer surface of said first connector housing, exposed from said fitting detection member, so that the appearance of said first connector housing, obtained when said fitting detection member is disposed in the initial position, is different in color from said appearance obtained when said fitting detection member is disposed in the proper fitting detection position.

5. A half-fitting prevention connector according to claim 2, wherein said retaining device includes a first retaining mechanism for retaining said fitting detection member at a front portion of said first connector housing, and a second retaining mechanism for retaining said fitting detection member at a rear portion of said first connector housing.

6. A half-fitting prevention connector according to claim 5, wherein said first retaining mechanism includes said positioning retaining portion, and a detection member-retaining portion which is defined by a front end edge of said flexible lock arm.

7. A half-fitting prevention connector according to claim 5, wherein said second retaining mechanism includes an elastic retaining portion, formed on the rear portion of the bottom portion of said first connector housing, and a retaining rib extending between inner surfaces of opposite side walls of said fitting detection member at a lower portion thereof.

8. A half-fitting prevention connector according to claim 5, wherein said second retaining mechanism includes retaining projections, formed respectively on opposite side surfaces of said flexible lock arm at a rear end thereof, and retaining piece portions formed respectively on opposed inner side surfaces of said fitting detection member at an upper end portion thereof.

9. A half-fitting prevention connector according to claim 5, wherein said second retaining mechanism includes a detection member-retaining arm, which is disposed adjacent to one side of said flexible lock arm, and has an engaging claw formed on an upper surface at a rear end thereof, and a retaining wall formed on a rear end of an upper wall of said fitting detection member.

10. A half-fitting prevention connector according to claim 5, wherein said second retaining mechanism includes a first projection, formed on a rear portion of a bottom portion of said first connector housing, and a second projection formed on a bottom portion of an inner peripheral surface of said fitting detection member.

11. A half-fitting prevention connector according to claim 10 wherein a height of engagement between said first and second projections is smaller than a height of engagement between said lock portion and said engagement portion.

12. A half-fitting prevention connector according to claim 2, wherein said fitting detection member is designed such that an inserting force, required when retaining said fitting detection member in the proper fitting detection position by said retaining device, is smaller than an inserting force required for fitting said first and second connector housings together.

13. A half-fitting prevention connector according to claim 12, wherein an angle of inclination of a tapering surface of said retaining piece portion is smaller than an angle of inclination of said engagement portion.

* * * * *